US005943085A

United States Patent [19]

Higashi et al.

[11] Patent Number: 5,943,085

[45] Date of Patent: Aug. 24, 1999

[54] IMAGE RECORDING DEVICE HAVING DETACHABLE WEB ROLL CASSETTE

[75] Inventors: Takashi Higashi, Nagoya; Yasuhiro Shibata, Okazaki; Koshiro Yamaguchi, Kasugai; Kiyoshi Sugimoto, Kuwana, all of Japan

[73] Assignee: Brother Kogyo Kabushiki Kaisha, Nagoya, Japan

[21] Appl. No.: 09/058,356

[22] Filed: Apr. 10, 1998

[30] Foreign Application Priority Data

Apr. 15, 1997 [JP] Japan ..... 9-096964

[51] Int. Cl.[6] ..... B41J 15/00; B41J 2/325

[52] U.S. Cl. ..... 347/222; 400/120.01; 347/171

[58] Field of Search ..... 347/171, 222; 400/120.01

[56] References Cited

U.S. PATENT DOCUMENTS

| | | | |
|---|---|---|---|
| 4,854,519 | 8/1989 | Maeda et al. . | |
| 5,232,297 | 8/1993 | Kitazawa . | |
| 5,725,318 | 3/1998 | Yamaguchi et al. | 400/120.02 |

FOREIGN PATENT DOCUMENTS

| | | |
|---|---|---|
| 0505943 A2 | 9/1992 | European Pat. Off. . |
| A-59-82250 | 5/1984 | Japan . |
| A-60-77055 | 5/1985 | Japan . |
| A-8-233675 | 9/1996 | Japan . |
| A-9-16815 | 1/1997 | Japan . |

*Primary Examiner*—Huan Tran

[57] ABSTRACT

An image recording device having a detachable web roll cassette in which a rolled web sheet is accommodated. The device includes a frame body having a web roll cassette insertion port, a web roll cassette accommodating portion, and a web sheet passage extending from the web roll cassette accommodating portion in a sheet feeding direction. The device also includes a web roll cassette, a rotary cutter positioned downstream of the web roll cassette, a sheet feeding unit including a drive roller and a pinch roller for nipping the web sheet therebetween, and a print head for printing the image on the web sheet fed by the sheet feed unit. The web roll cassette includes an upper and lower cases accommodating therein a web roll at one side and defining a front end discharge portion at another side directing toward the web sheet passage. The upper and lower cases are formed with through holes at a position adjacent the front end discharge portion. The drive roller and the pinch roller are respectively positioned at the through holes.

21 Claims, 14 Drawing Sheets

IMAGE RECORDING DEVICE HAVING DETACHABLE WEB ROLL CASSETTE

BACKGROUND OF THE INVENTION

The present application is closely related to a commonly assigned U.S. patent application entitled "Web roll and web roll cassette detachably mounted in printer" and filed on the even date.

The present invention relates to an image recording device such as a thermal head printer which detachably installs a web roll cassette in which a rolled image recording medium or a web roll is accommodated.

A conventional image recording device that has become of practical use is a tape-shaped label printing device described in U.S. Pat. No. 5,232,297 and Japanese Patent-Application Publication (Kokai) No. HEI-8-233675. The conventional device includes a recording device having a frame body, a keyboard, a display, and a thermal printing type recording mechanism, and a label cassette housing a recording tape and an ink ribbon. The label cassette is interchangeably mounted in a cassette accommodating section of the recording device. A thermal head prints on the recording tape via the ink ribbon, according to text characters and symbols input from the keyboard. The printed labels are appropriate for adhering to the spines of files and the like.

SUMMARY OF THE INVENTION

Conventionally, the recording tape used in these recording devices has been relatively narrow, that is, about 6–24 millimeters. Recently, however, wider recording tape is also in demand for use in signboards, as those used in giving directions or stating prices.

For this reason, the inventor of the present invention proposed a recording device construction in inhouse R & D activities. In the proposed construction, a wide recording medium wound into a roll-shape (hereinafter referred to as a "web roll") is set in a web roll accommodating portion in the frame body. While the web roll is conveyed in a conveying direction, a thermal head prints on the web by moving back and forth in a direction orthogonal to the conveying direction. Further, a cutter is provided for cutting the recording medium after the web has been printed. A web feed means is provided in this device at positions upstream and downstream of the print portion including the thermal head and a platen with the print portion interposed therebetween. In order to replace the web roll with a new web roll, the feed means is driven in reverse direction to rewind the web roll so that a leading edge of the web roll is reversely moved passed the upstream side feed means.

However, because the web roll is directly housed in a frame body of the printer, at the start of printing, both feed means must be driven in the forward direction to feed the leading edge of the web past the print portion to the downstream-side feed means. During this feeding operation, paper jams easily occur. On the other hand, when the web roll is replaced, the leading edge of the recording medium is rewound from the position of the downstream-side feed means to a position past the upstream-side feed means. The distance that the recording medium must be rewound is relatively long so that replacing the recording medium is troublesome.

Further, if jamming of wider sheet occurs, it would be troublesome to remove the jammed sheet from the sheet feed passage, because the sheet feed passage is surrounded by various components such as the printing portion including the platen and the thermal head and the sheet feed mechanism. Even if the frame body of the recording device is opened, it would be difficult to access the jammed sheet.

It is therefore, an object of the present invention to overcome the above-described problems and to provide an improved image recording device capable of facilitating a setting operation of the recording medium at a proper sheet feed passage.

Another object of the present invention is to provide such image recording device in which the sheet feed passage can be opened easily with a simple arrangement for facilitating removal of jammed recording medium.

These and other objects of the present invention will be attained by providing an image recording device for forming an image on a web sheet including a frame body, a detachable web roll cassette, a cutter unit, a sheet feeding unit, and a printing unit. The frame body is provided with a web roll cassette insertion port, a web roll cassette accommodating portion, and a web sheet passage extending from the web roll cassette accommodating portion in a sheet feeding direction. The web roll cassette is detachably mounted in the web roll cassette accommodating portion through the cassette insertion port. The web roll cassette includes a case accommodating therein a web roll from which the web sheet is unwound in the sheet feeding direction. The web roll cassette has a front end discharge portion directing toward the web sheet passage, and the casing is formed with a through hole at a position adjacent the front end discharge portion. The cutter unit is positioned downstream of the front end discharge portion in the sheet feeding direction for cutting the web sheet drawn out of the front end discharge portion. The sheet feeding unit is adapted for feeding the web sheet in the sheet feeding direction, and includes a pair of nipping members positioned at the through hole for nipping the web sheet between the pair of nipping members. The printing unit is adapted for printing the image on the web sheet fed by the sheet feed unit.

In another aspect of the invention, there is provided an image recording device for forming an image on a web sheet unwound from a web roll including the frame body, the feeding unit, the printing unit, a front guide projection, a rear guide projection, a pivot mechanism, and a web roll cassette. The front guide projection protrudes from the cassette accommodating portion. The rear guide projection protrudes from the cassette accommodating portion and at a position higher than the front guide projection. The pivot mechanism is adapted for pivotally moving the web roll cassette between an operating position in horizontal alignment with the rear guide projection and a slanted inserting position. The web roll cassette houses therein the web roll serving as an image recording medium. The web roll cassette includes a lower case having one side and another side, and upper case, and a platen. The upper case is supported on the lower case and has one side and another side. The upper and lower cases selectively provide an opening state and a closing state and define therein an accommodation space at the one side for accommodating therein the web roll in the closing state. A front end discharge portion is formed at the another side of the upper and lower cases in the closing state. The front end discharge portion is engageable with the pivot mechanism. The platen is provided at a position upstream of the front discharge portion in the feeding direction. The platen is confrontable with the printing unit. Through holes are formed in the upper and lower cases at a position between the front discharge portion and the platen for allowing the feeding unit to be positioned in the through holes. A guide groove is formed at a lateral side of the lower case for engaging with the front and rear guide projections.

In still another aspect of the invention, there is provided an image recording device for forming an image on a web sheet including a frame body, a web roll cassette, a sheet feeding unit, a printing unit, a pair of front guide projection and a rear guide projection, a guided member, and a pivot mechanism. The frame body is provided with a web roll cassette insertion port, a web roll cassette accommodating portion, and a web sheet passage extending from the web roll cassette accommodating portion in a sheet feeding direction. The web roll cassette accommodating portion has a pair of inner side walls. The web roll cassette is detachably mounted in the web roll cassette accommodating portion through the cassette insertion port. The web roll cassette includes a case accommodating therein a web roll from which the web sheet is unwound in the sheet feeding direction. The web roll cassette has a front end discharge portion directing toward the web sheet passage. The web sheet unwound from the web roll is discharged out of the web roll cassette through the front end discharge portion. The case has a pair of side ends each in confrontation with each inner side wall of the web roll cassette accommodating portion. The sheet feeding unit is adapted for feeding the web sheet in the sheet feeding direction. The printing unit is adapted for printing the image on the web sheet fed by the sheet feed unit. The rear guide projection is positioned upstream of the front guide projection in the sheet feeding direction. The front and rear guide projections protrude, in a direction perpendicular to the sheet feeding direction, from one of the pair of side ends of the web roll cassette and the pair of inner side walls. The guided member has a groove slidingly engageble in the pair of front and rear guide projections when the web roll cassette is installed into the web roll accommodating portion through the insertion port. The guided member is provided at remaining one of the pair of side ends and the pair of inner side walls. The engagement between the front and rear guide projections and the groove defines an inserting position of the web roll cassette. The pivot mechanism is provided in the web roll accommodating portion for pivotally moving, about the rear guide projection, the web roll cassette so that the front end discharge portion of the web roll cassette is moved from the inserting position toward the web sheet passage and into an operating position.

BRIEF DESCRIPTION OF THE DRAWINGS

In the drawings:

FIG. 12(*b*) is a partial perspective view showing the shutter in a closed state according to the embodiment;

FIG. 13(*b*) is an enlarged side cross-sectional view showing the relative parts of the shutter in an open state;

DETAILED DESCRIPTION OF THE PREFERRED EMBODIMENTS

A web roll and a web roll cassette according to a preferred embodiment of the present invention will be described while referring to the accompanying drawings.

Figure 1:
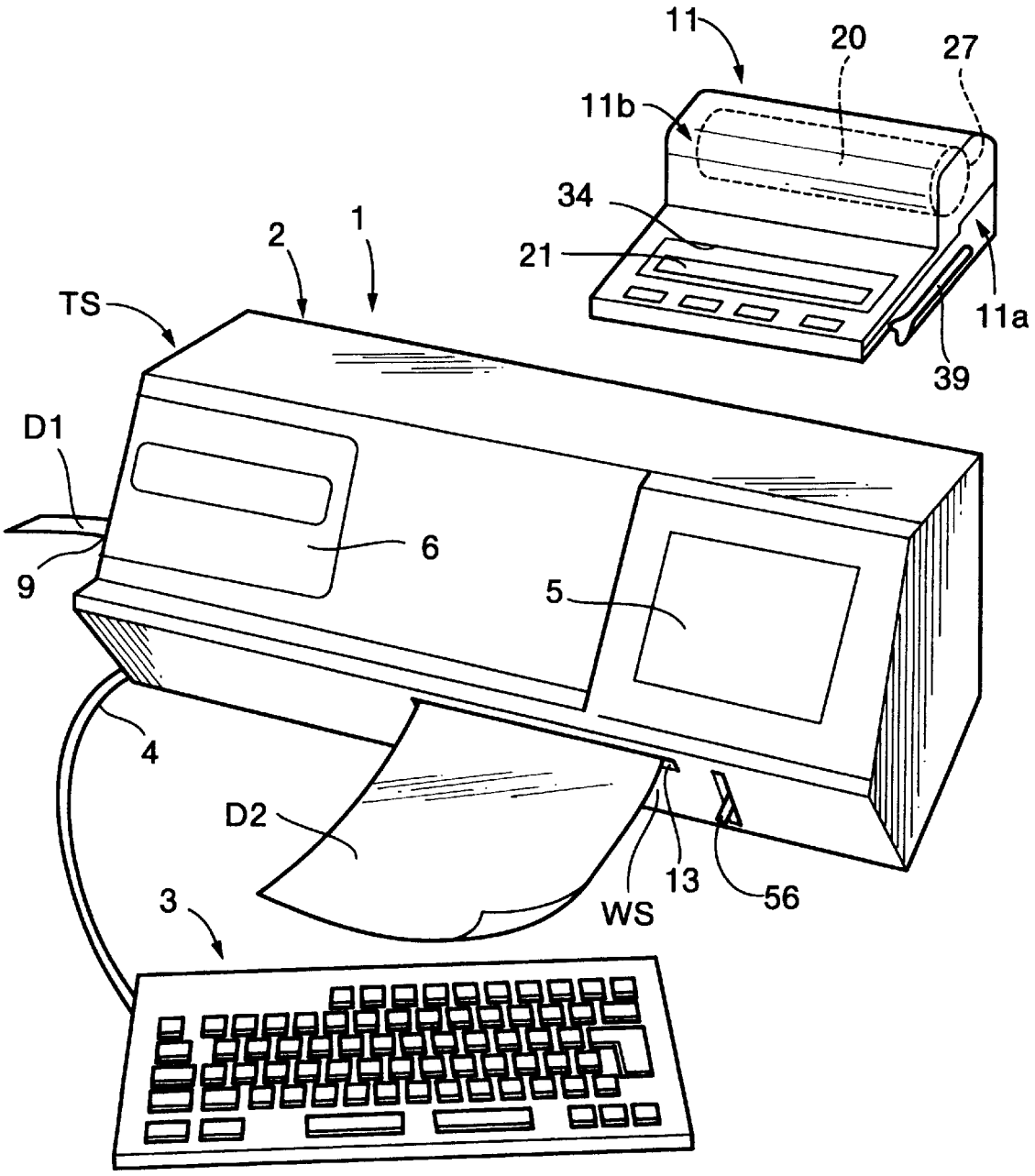
FIG. 1 is a perspective view showing a tape printing device and a web roll cassette according to a preferred embodiment of the present invention.

First, a recording device and a general arrangement of a web roll cassette according to the present embodiment will be described with reference to FIGS. 1 and 2. The recording device is a tape printer 1 for printing various characters and symbols, including alphabet, hiragana, kanji, and the like, on a wide or a narrow recording medium, such as a recording tape. The printer 1 includes a frame body 2 which houses two stations, a tape station TS and a wide station WS. The tape station TS is provided to record on a first recording medium, which is a narrow recording medium D1. The wide station WS is provided to record on a second recording medium, which is a wide recording medium or a web sheet D2.

A keyboard 3 is provided with character and symbol keys, such as a new line key, character keys, and function keys, such as an execute key. A cable 4 connects the keyboard 3 to the printer 1. Various data and command signals are transmitted from the keyboard 3 via the cable 4 to a control unit (not shown) provided in the printer 1. A display 5 such as a liquid crystal display is provided on the right portion of the frame body 2 shown in FIG. 1 for displaying characters and the like inputted from the keyboard 3, as well as various instructions.

A cover member 6 is disposed on the left portion of the frame body 2 and can be opened and closed. Opening the cover member 6 reveals the tape station TS. A discharge opening 13 is formed in a front wall of the frame body 2 for discharging a printed wide web sheet D2. Another discharge port 9 is formed in the left end of the frame body 2 for discharging the narrow recording medium D1. Further, a lever 56 is accessibly provided in the front wall of the frame body 2 so as to change posture of a web roll cassette 11 when the cassette 11 is installed in the frame body 2 as described later.

The web roll cassette 11 is detachably mounted in the wide station WT. The web roll cassette 11 is mounted through an insertion port 12 (FIG. 2), which serves as the mounting portion in the rear of the frame body 2. The wide web sheet D2, which is wound into a roll shape (hereinafter referred to as a web roll 20), is contained within the web roll cassette 11. The web roll cassette 11 includes a lower case 11*a* and an upper case 11*b*, both of which are formed of synthetic resin material through an injection molding process. The upper case 11*b* provides an accommodation space 27 for accommodating therein the web roll 20. A flat plate-shaped platen 21 is exposed on the top surface near the front end (or discharge portion) of the web roll cassette 11. A rectangular shaped opening 34 is formed in the upper case 11*b* for exposing the top of the platen 21. The lower case 11*a* has side walls at which guide grooves 39 are formed for guiding insertion of the web roll cassette 11 into the frame body 2.

Figure 2:
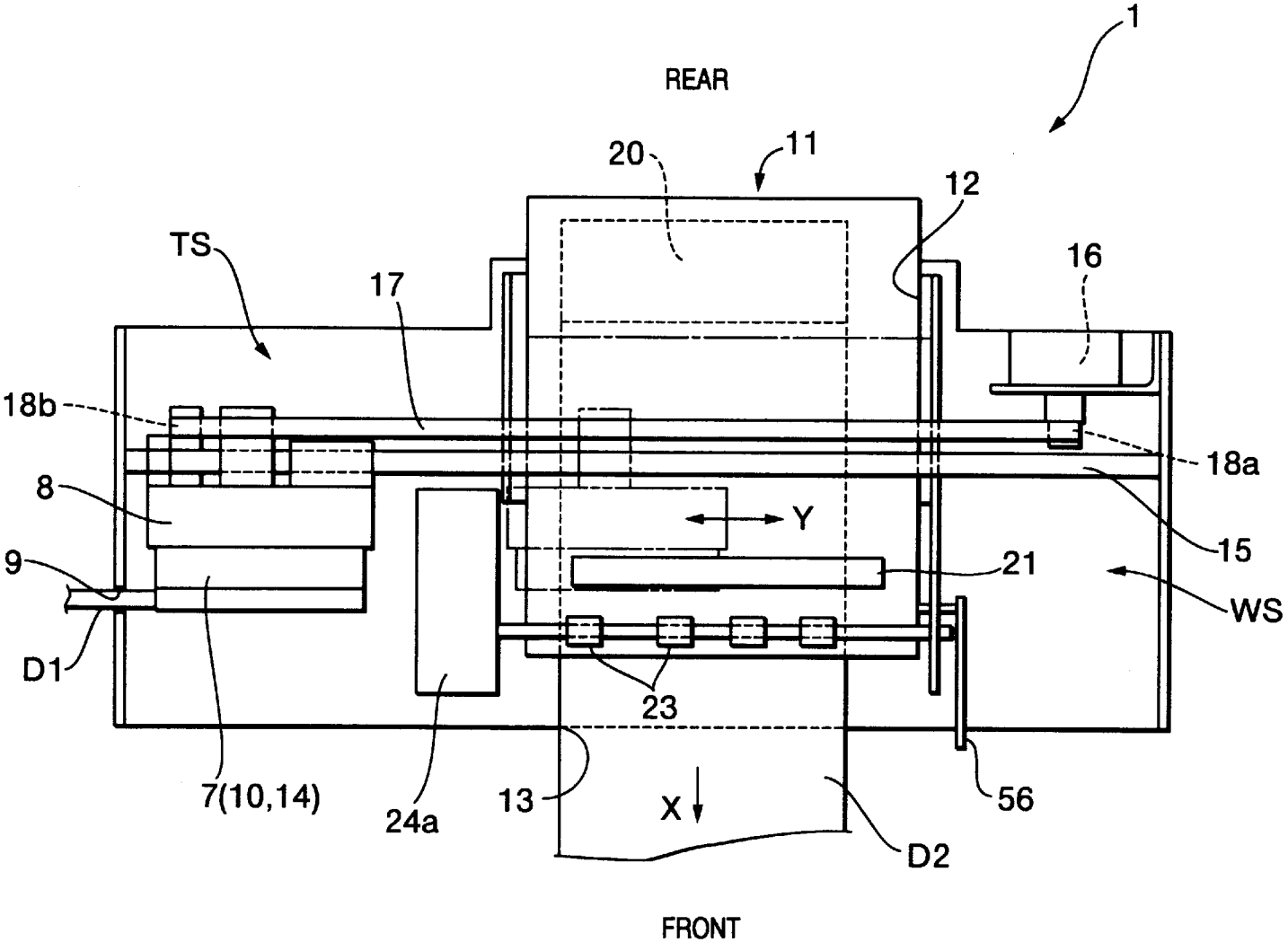
FIG. 2 is a plan view showing a general structure of the tape printing device according to the embodiment.

As shown in FIG. 2, the tape station TS includes a carriage 8, a tape cassette 7 mounted in the carriage 8 and housing therein the narrow recording medium D1 and an ink ribbon, a thermal head 10 disposed on the carriage 8 as the printing unit, a platen roller (not shown) provided movably toward and away from the thermal head 10 for selective contact therewith, the discharge port 9, and a cutting device (not shown in FIG. 2) disposed near the discharge port 9. The platen 21 is positioned in opposition to the thermal head 10. The recording medium D1 and the ink ribbon are conveyed between the thermal head 10 and the platen roller during the printing operation. The conveyed ink ribbon is wound up in the tape cassette 7, and the printed recording medium D1 is discharged from the discharge port 9. At this time, the cutting device can be used to cut the recording medium D1 to a desirable length.

The carriage 8, which supports the thermal head 10 is movably supported on a guide shaft 15 extending in the Y direction, i.e., a widthwise direction of the web roll 20. A drive pulley 18*a* and a driven pulley 18*b* are disposed one near either end of the guide shaft 15. A timing belt 17 is wrapped around the drive pulley 18*a* and the driven pulley 18*b*. One portion of the timing belt 17 is attached to the carriage 8. A stepper motor 16 is provided for driving the drive pulley 18*a* in order to move the carriage 8 back and forth in the Y direction.

A feed mechanism 24*a* including a drive motor (not shown), gears (not shown), and the like is provided in the frame body 2 for feeding the web roll 20 in an X direction, i.e., frontward direction. Further, a plurality of pinch rollers 23 are rotatably disposed at a position above the web roll 20. As described above, the insertion port 12 is provided at the rear side of the frame body 2, and the lever 56 pivotally extends frontwardly at the front wall of the frame body 2. In addition, a rotary type cutter 81 (FIG. 13(*a*)) is disposed near the discharge opening 13 for cutting the web sheet D2 in the Y direction.

In order to print on the web sheet D2 in a serial recording mode, a ribbon cassette 14 is installed on the carriage 8 instead of the tape cassette 7. The ribbon cassette 14 houses therein a single or multiple color ink ribbon. The web sheet D2 is conveyed in the X direction from the end of the web roll cassette 11 toward the discharge opening 13, while the thermal head 10 moves in the Y direction orthogonal to the web sheet D2 and prints on the web sheet D2. By opening the cover member 6, the ribbon cassette 14 can be freely and interchangeably mounted on the carriage 8.

A drive roller 22 (FIGS. 4 and 5), which is the main paper conveying roller is positioned on the lower side of the front end discharge portion of the web roll cassette 11 via a pivot mechanism 24*b* (FIGS. 3 and 4) described later. The pinch rollers 23 are fixedly disposed at a position above the drive roller 22. The drive roller 22 is driven to rotate by the feed mechanism 24*a*.

Figure 3:
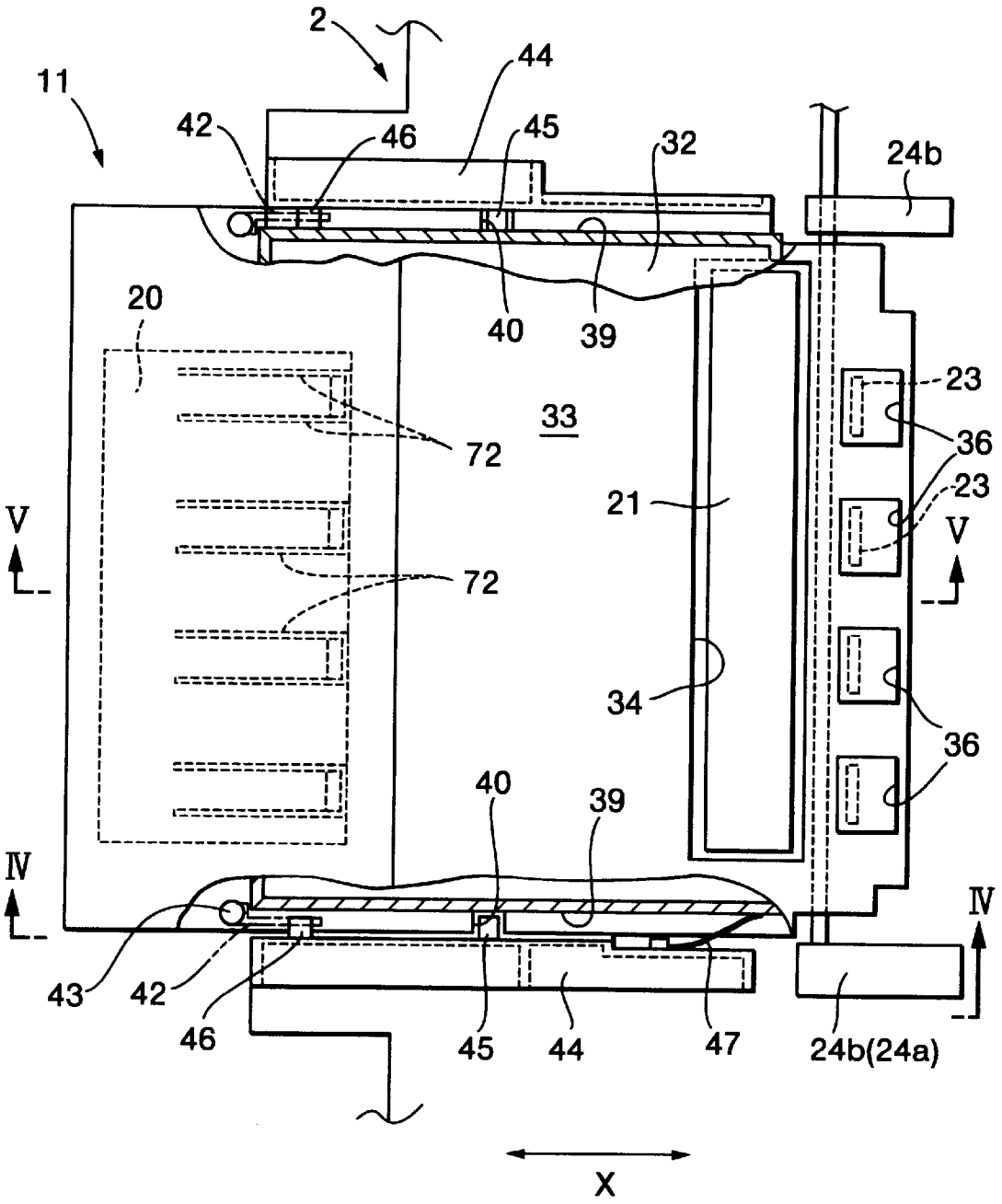
FIG. 3 is a partial plan view showing a mounting portion of a web roll cassette according to the embodiment.
Figure 4:
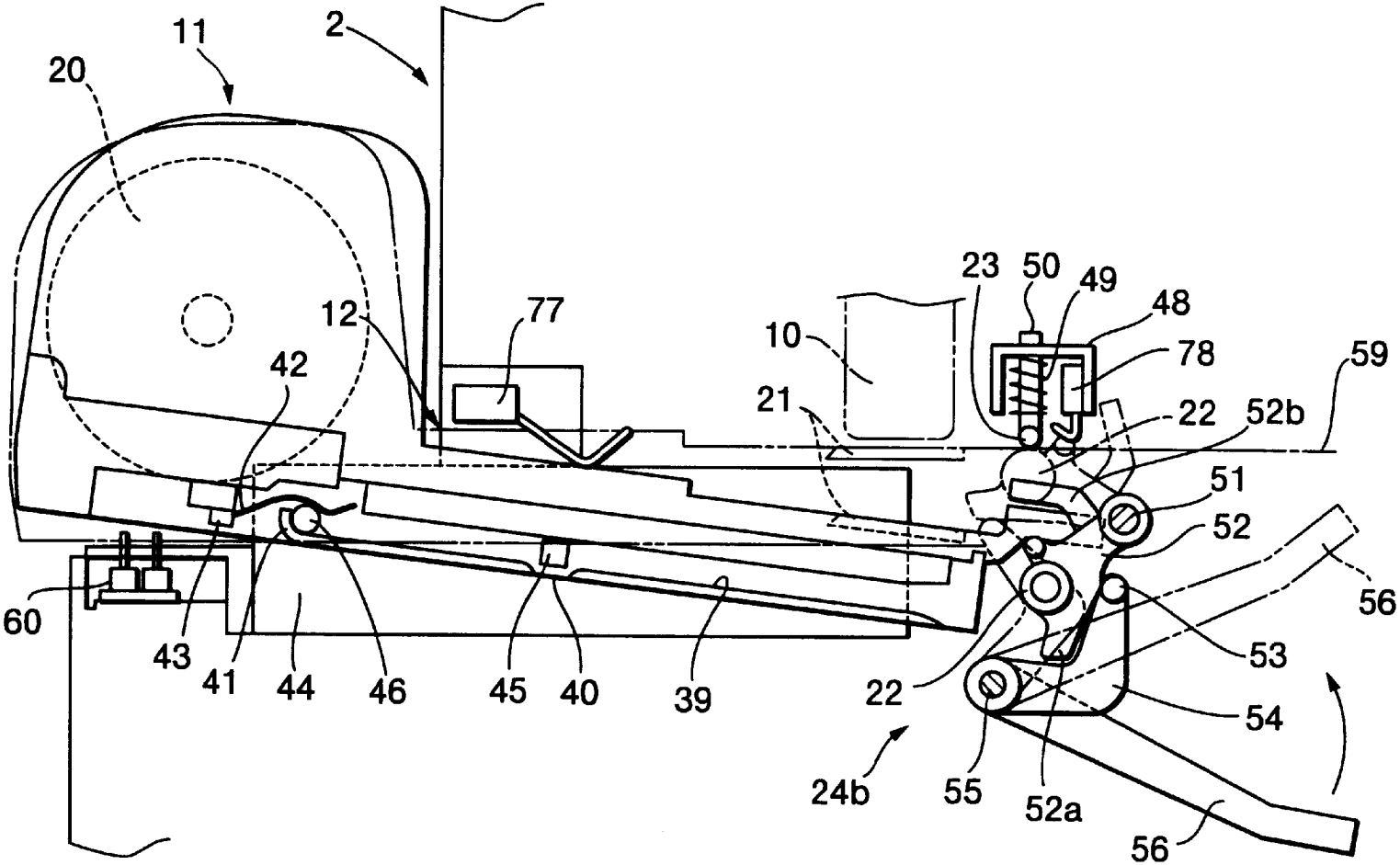
FIG. 4 is a partial cross-sectional side view as viewed from a direction indicated by arrows IV in FIG. 3.

As shown in FIGS. 3 and 4, guide frames 44 are fixed on the left and right sides of the insertion port 12 extending in the insertion direction of the web roll cassette 11 and are disposed so as to provide sliding contact with the left and right sides of the web roll cassette 11. Front guide projections 45 are disposed on the guide frame 44 toward the web roll cassette 11. Cylindrical and horizontally extending rear guide projections 46 are also disposed on the guide frame 44 and are positioned at an appropriate distance behind the front guide projections 45 in the insertion direction of the web roll cassette 11 and at positions higher than the front guide projections 45. The pairs of front guide projections 45 and rear guide projections 46 can be slid into the left and right guide grooves 39 of the web roll cassette 11.

Next, the structure of the web roll cassette 11 will be described with reference to FIGS. 3–11. As best shown in FIG. 8, the lower case 11*a* includes support portions 25 and 26 for freely and rotatably supporting the left and right ends of the web roll 20. The lower case 11*a* also includes side guide plates 29 and 30 for guiding the left and right edges of the web sheet D2 drawn from the web roll 20, and a nose portion 32. The nose portion 32 is provided with the platen 21 and a tray (described later) 31 for guiding the lower surface of cut sheets such as postcards. A through-hole 35 penetrates the front portion of the nose portion 32 and is formed in a long rectangular shape when seen in a plan view. The through-hole 35 allows a part of the drive roller 22 to be protruded therefrom as shown in FIG. 5.

Figure 5:
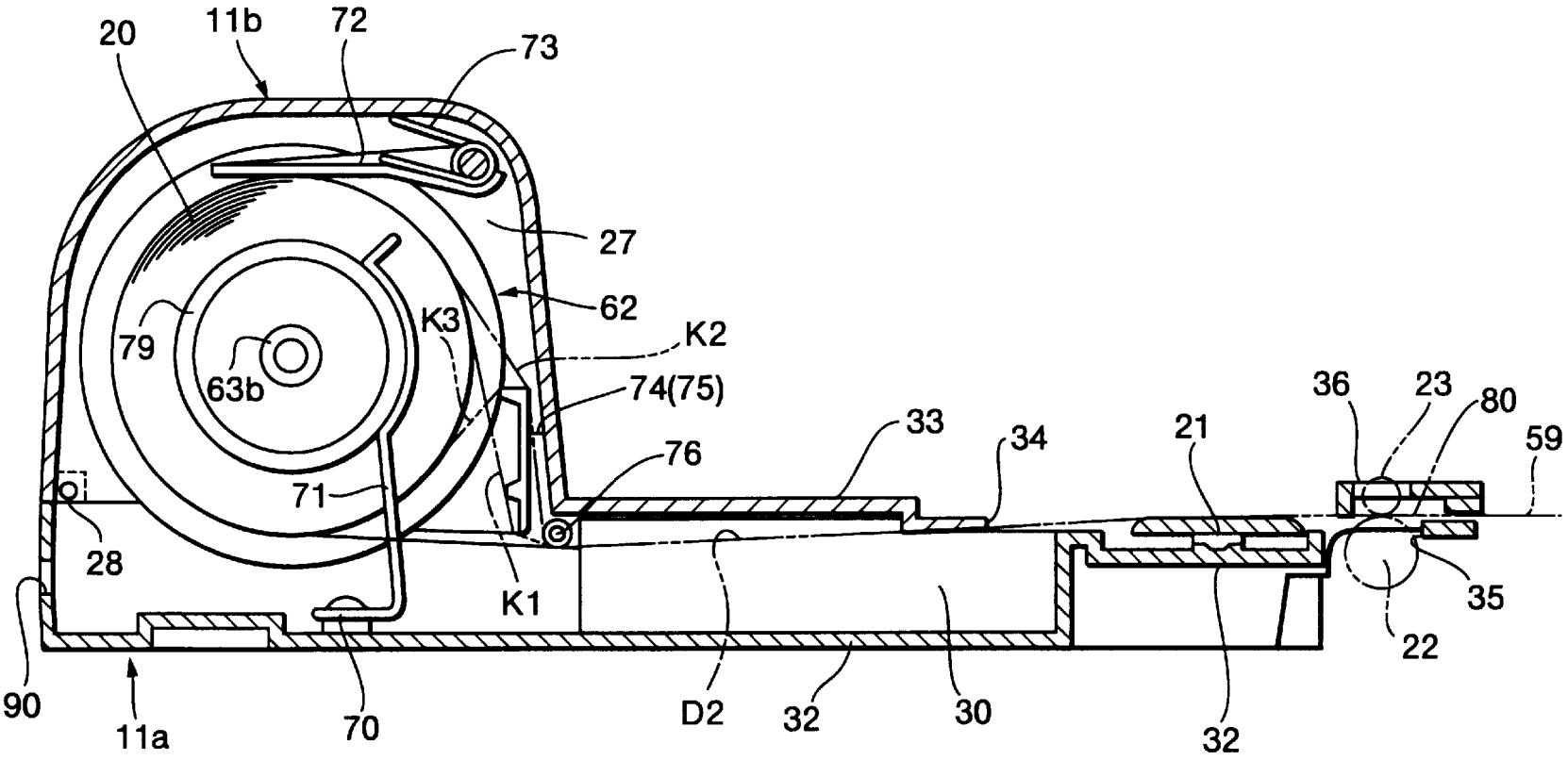
FIG. 5 is a cross-sectional view taken along the line V—V in FIG. 3.

As shown in FIGS. 3 and 5, the upper case 11*b* includes a flat portion 33 extending from the front of the accommodation space 27 for covering the side guide plates 29, 30, and tray 31 of the lower case 11*a*. The opening 34 is formed in the top wall of the upper case 11*b*. Through-holes 36 are formed in the flat portion 33 above the through-hole 35. The pinch rollers 23 can be seen from the top side of these through-holes 36 (FIG. 5).

Figure 6:
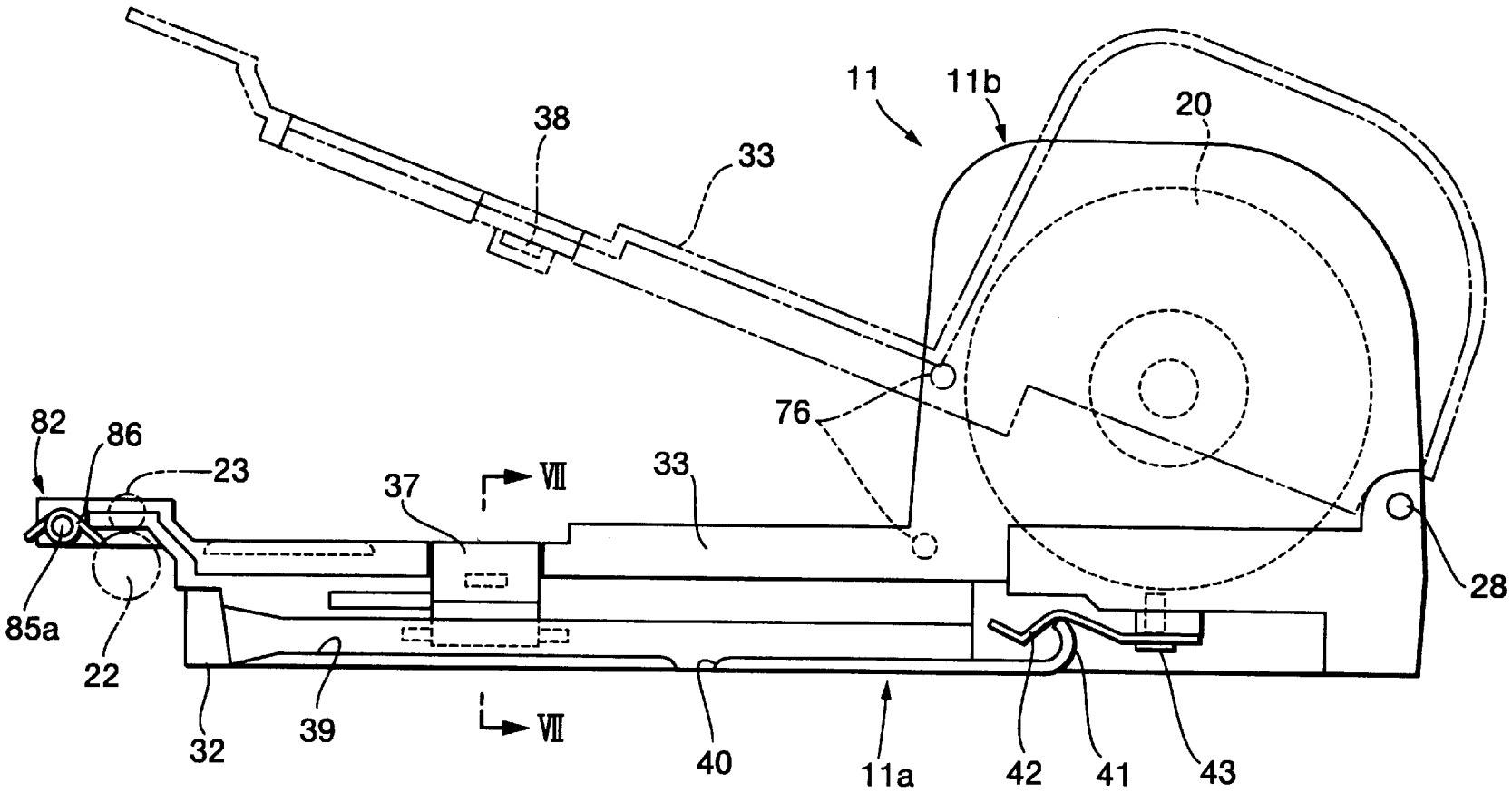
FIG. 6 is a side view of the web roll cassette according to the embodiment.

The upper case 11*b* is pivotably mounted on the lower case 11*a* via a pivot shaft 28 and can open and close by pivoting on this pivot shaft 28 (see FIG. 6). The pivot shaft 28 is positioned opposite the front end discharge portion and adjacent the accommodation space 27. This pivot position is advantageous because an area adjacent the web roll accommodation space 27 has a rigidity higher than that at the front end discharge portion where the opening 34, and the through holes 35, 36 are formed. The web roll cassette 11 is inserted into the frame body 2 via the insertion port 12 when the flat portion 33 is closed against the nose portion 32. When the nose portion 32 and flat portion 33 are closed together, as shown in FIG. 5, a passage 80 is formed between the front ends of the nose portion 32 and the flat portion 33 through which the web sheet D2 can be discharged.

Figure 7:
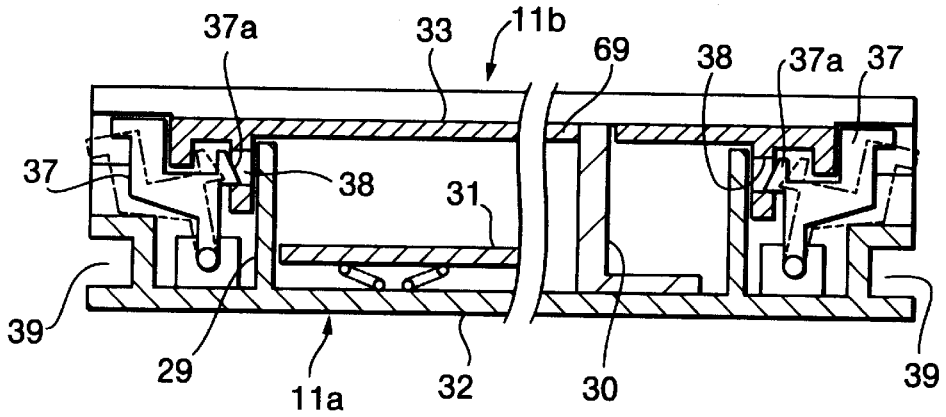
FIG. 7 is a cross-sectional view taken along the line VII—VII in FIG. 6.
Figure 8:
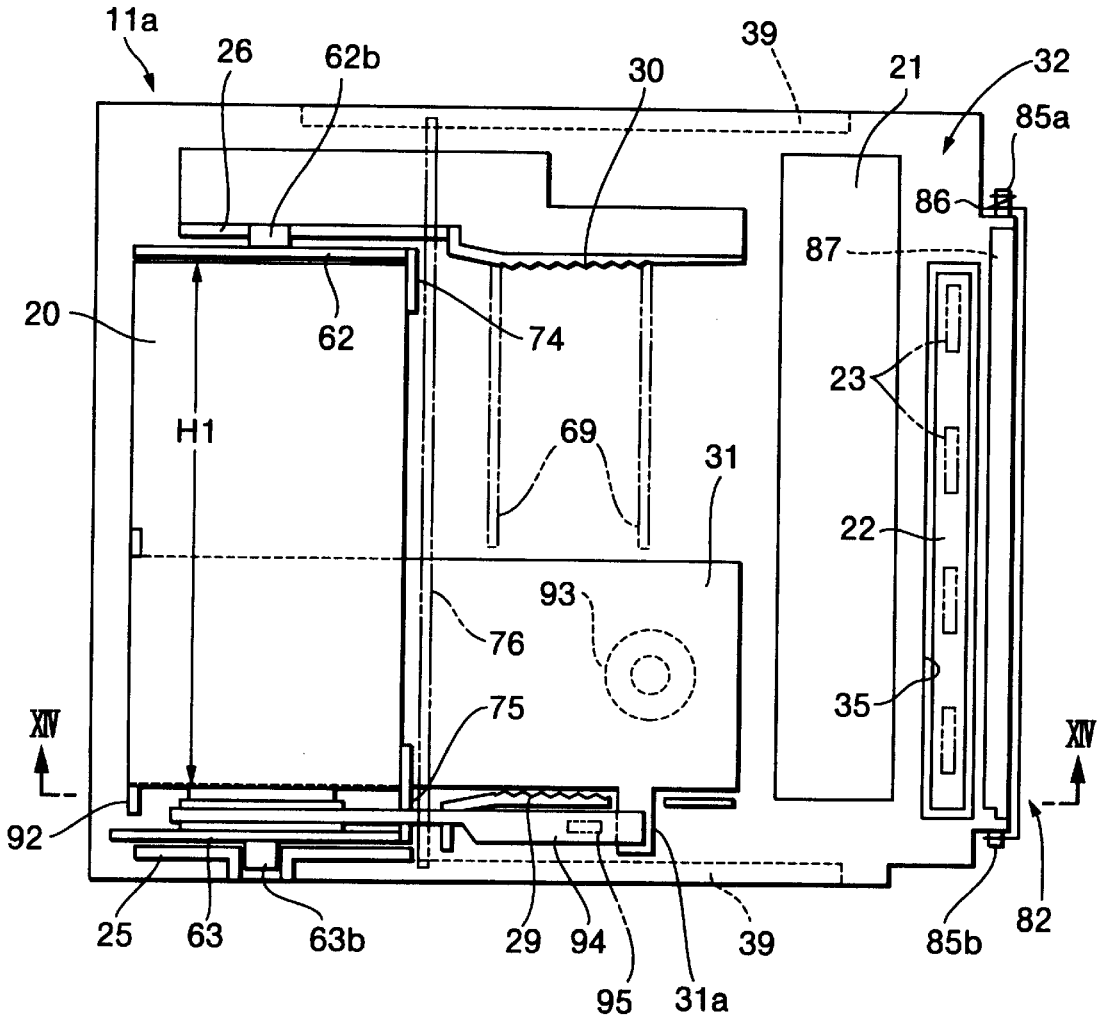
FIG. 8 is a plan view showing a lower case when an upper case has been removed according to the embodiment.

As shown in FIGS. 6 and 7, locking pawls 37 are rotatably disposed on the left and right sides of the nose portion 32 and can be pivoted moved outwardly. The locking pawls 37 have pawl portions 37*a*. Locking openings 38 are formed in the lower left and right sides of the flat portion 33. When the tops of the locking pawls 37 are rotated upwardly and inwardly as indicated by the solid lines in FIG. 7, pawl portions 37*a* engage the locking openings 38. Thus, the upper case 11*b* is fixed to the lower case 11*a*. When the tops of the locking pawls 37 are rotated outwardly as indicated by the broken lines in FIG. 7, the pawl portions 37*a* is disengaged from the locking openings 38. Thus, the upper case 11*b* can be opened with respect to the lower case 11*a*.

As shown in FIGS. 3, 4, 6, and 7, the guide grooves 39 are formed along the outer side surfaces of the nose portion 32, opening slightly wider near the front end of the web roll cassette 11, which end is inserted first into the frame body 2. Each of the guide grooves 39 includes a notched portion 40 formed as an opening in the lower side center of each guide groove 39, and a stop portion 41 near the rear end of the web roll cassette 11. The stop portions 41 are engageable with the rear cylindrical guide projections 46 of the guide frame 44. A locking spring 42 is fixed by a screw 43 to each side of the web roll cassette 11. The free end of the locking springs 42 press against the rear guide projections 46 for maintaining engagement between the stop portions 41 and the rear guide projections 46 as best shown in FIG. 4.

The distance between the front guide projections 45 and the rear guide projections 46 is set such that the front guide projections 45 is aligned with the notched portions 40 when the rear guide projections 46 are engaged by the stop portions 41. A leaf spring 47 (FIG. 3) is disposed on at least one guide frame 44 and in sliding contact with the guide groove 39 to restrain left and right movement of the web roll cassette 11.

Next, the construction of the pivot mechanism 24*b* will be described. The pivot mechanism 24*b* functions for selectively rotating the front discharging side of the web roll cassette 11 between an inclined insertion position along the guide projections 45 and 46 and a raised position along the web sheet D2 conveying path as shown by solid line and two dotted chain line in FIG. 4. A bracket 48 is disposed inside the frame body 2 and above a feed passage 59. A support frame 50 is mounted in the bracket 48 and is movable upward and downward. Each of the plurality of pinch roller 23 is freely and rotatably supported on both ends by the support frame 50. The support frame 50 is urged downward by a coil spring 49. In the bracket 48, a limit switch 78 is provided for detecting a leading edge of the image recording medium.

The elongated drive roller 22 for conveying the wide web sheet D2 or a cut sheet is disposed in opposition to the pinch rollers 23 on the lower side of the feed passage 59. The drive roller 22 is supported on a support arm 52. The support arm 52 is pivotably supported on a pivot shaft 51 extending from the frame body 2. The support arm 52 has a first engaging portion 52*a* extending downward from the drive roller 22, and a second engaging portion 52*b* integrally formed with the first engaging portion 52*a* and extending upward from near the pivot shaft 51 toward the front end of the upper case 11*b*.

An operation arm 54 is supported to a pivot shaft 55 rotatably extending from the frame body 2. The pivot shaft 55 has an irregular cross-section to provide a fixed connection to one end of the operation arm 54. Further, the lever 56 has a base end fixedly connected to the pivot shaft 55. Therefore, the pivotal movement of the lever 56 about an axis of the pivot shaft 55 provides a pivotal motion of the operation arm 54. A pressure roller 53 is provided at a free end of the operation arm 54. The pressure roller 53 is adapted to press onto the surface of the support arm 52. A locking device (not shown) is provided to lock a raised position of the lever 56, the raised position being shown by two dotted chain line in FIG. 4.

When the support arm 52 is rotated in the clockwise direction, the first engaging portion 52*a* engages with the lower front end of the nose portion 32 and lifts the front end of the web roll cassette 11 upward. When the support arm 52 rotates counterclockwise, the second engaging portion 52*b* engages with the front end bottom surface of the upper case 11*b* and pushes the front end of the web roll cassette 11 downward. This pivotal movement of the support arm 52 is provided by the manipulation of the lever 56.

Figure 9:
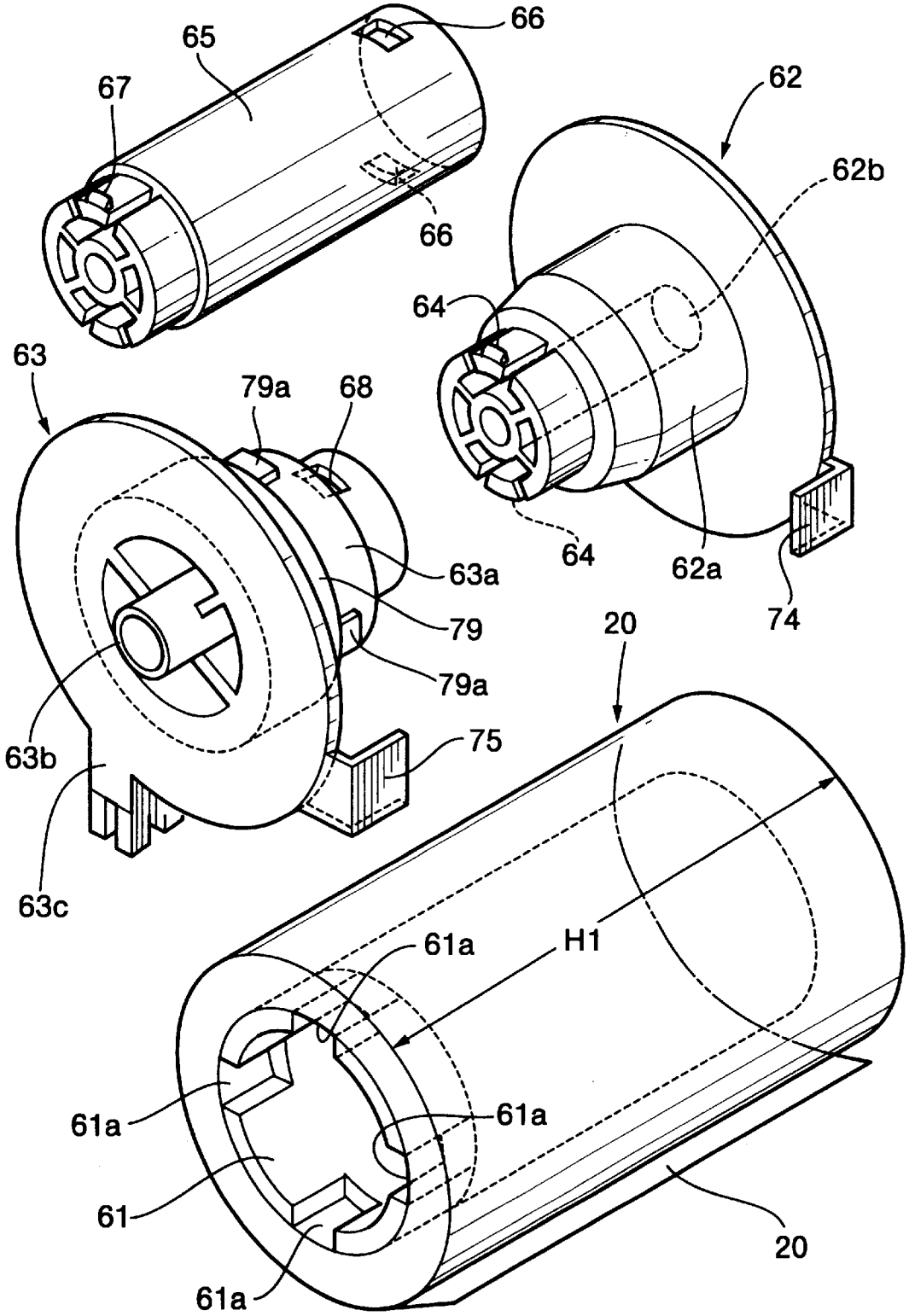
FIG. 9 is a segmental perspective view showing a web roll, left and right holders, and a connection tube according to the embodiment.

Next, a structure of the web roll 20 in the web roll cassette 11 will be described. As shown in FIG. 9, the web roll 20 having a width H1 is wrapped around a sheet tube 61, which functions as the core body. The web roll 20 is mounted on the left and right holders 62 and 63 such that the web roll 20 is rotatable and will not slip off the holders 62 and 63. An inner boss 62*a* is provided on the holder 62. A plurality of engaging pawls 64 is resiliently deformably disposed on the inner boss 62*a*. A connection tube 65 having a prescribed length fits into the sheet tube 61. A plurality of engaging holes 66 corresponding to the plurality of engaging pawls 64 are formed in one end of the connection tube 65. The plurality of engaging pawls 64 can engage with and disengage from the plurality of engaging holes 66. In addition, a plurality of engaging pawls 67 is resiliently deformably disposed on the other end of the connection tube 65. An inner boss 63*a* is disposed on the holder 63. A plurality of engaging holes 68 corresponding to the plurality of engaging pawls 67 are formed in the inner boss 63*a*. The plurality of engaging pawls 67 can engage with and disengage from the plurality of engaging holes 68.

The holders 62 and 63 disposed on the left and right ends of the web roll 20 via the connection tube 65 are positioned near the left and right ends of the web roll 20 and serve to protect these ends. Therefore, the length of the connection tube 65 should correspond to the width of the web roll 20. When the width of the web roll 20 is of a minimum size, the engaging pawls 64 on the inner boss 62*a* of the holder 62 should directly engage with the engaging holes 68 on the inner boss 63*a* of the holder 63 within the sheet tube 61. When the web roll 20 is supplied to the user, the web roll 20 is provided between the left and right holders 62 and 63, which are connected via the connection tube 65. Therefore, the user will generally not need to remove the holders 62 and 63. Further, by integrally supplying the holders 62 and 63 having a larger external diameter than the diameter of the web roll 20, the left and right ends of the roll-shaped web sheet D2 will not contact external objects and will not become damaged. Also, providing at least one of the holders 62 and 63 in a non-circular shape can prevent the holders 62 and 63 from rolling.

A support boss 62*b* protrudes externally from the center portion of the holder 62 and is fitted from above into a support groove (not shown) that opens upwardly in the support portion 26 (FIG. 8). A support boss 63*b* protrudes outwardly from the center of the holder 63 and is fitted from above into a support groove (not shown) that opens upwardly in the support portion 25 (FIG. 8). This construction allows the web roll 20 to be replaced together with the holders 62 and 63. The support portion 26 and the side guide plate 30 described above are integrally formed and capable of moving sideways nearer or further in relation to the support portion 25 in order to correspond to the width H1 of the web roll 20. For this purpose, guide grooves 69 (FIG. 7) are formed in the bottom surface of the flat portion 33 in the upper case 11*b* in order to allow protruding guides (not shown) on the upper end of the side guide plate 30 to move in a horizontal direction across the guide grooves 69.

Figure 10:
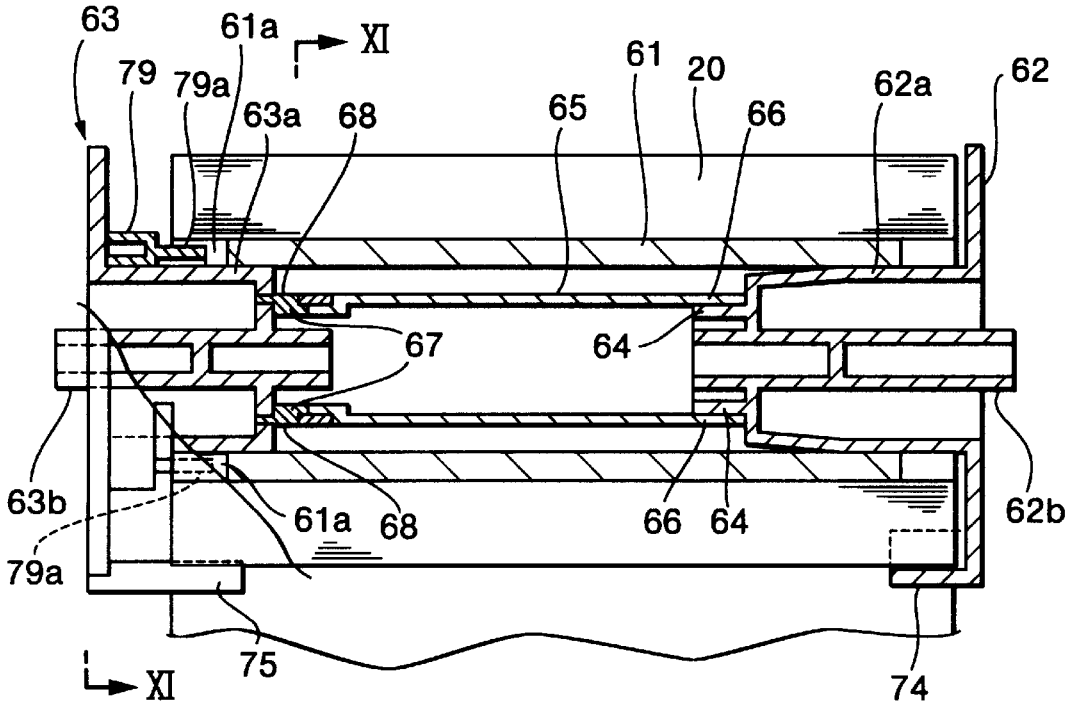
FIG. 10 is a cross-sectional view showing the state of the web roll mounted in the left and right holders according to the embodiment.
Figure 11:
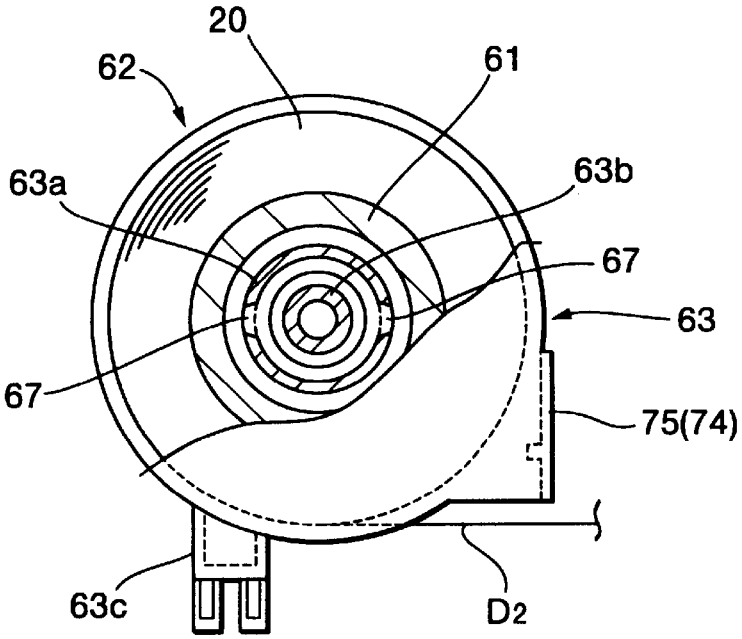
FIG. 11 is a partial cross-sectional view taken along the line XI—XI in FIG. 10.

As shown in FIGS. 9 and 10, a sleeve 79 having a large diameter is freely and rotatably fitted on the inner boss 63*a*. Engaging projections 79*a* are formed integrally on and protrude from the sleeve 79. A plurality of recessed portions 61*a* are formed in one side of the sheet tube 61 and correspond to the engaging projections 79*a*. The engaging projections 79*a* are fit into the recessed portions 61*a*. Thus, the web roll 20 is supported rotatably with respect to the holders. Near the support portion 26 (FIG. 8), a leaf spring shaped brake member 71 (FIG. 5) is fixed to the base of the lower case 11*a* via a screw 70 and contacts the outer surface of the sleeve 79 in order to prevent excessive rotations of the web roll 20.

In the accommodation space 27 of the upper case 11*b*, a plurality of unroll-preventing members 72 (FIG. 5) are provided for applying sliding pressure to the external surface of the web roll 20 via the urging force of a plurality of torsion springs 73. The brake member 71 and unroll-preventing member 72 apply a force to the web roll 20 to restrain excess rotations. Therefore, the brake member 71 and unroll-preventing member 72 not only prevent the web sheet D2 from becoming slack, but also apply a load against the conveying direction of the web sheet D2. As a result, the web sheet D2 can be conveyed in an appropriately taut condition for greater conveying accuracy.

For preventing the holders 62 and 63 from rotating, a sensor portion 63*c* is provided which protrudes externally in the radial direction on one side of the holder 63 and fits in an opening formed in a prescribed position in the lower case 11*a*. With this construction, the sensor portion 63*c* is exposed on the outside of the web roll cassette 11. As shown in FIG. 4, cassette detection switches 60 are disposed at prescribed locations on the frame body 2 so as to oppose the sensor portion 63*c* exposed from openings formed in prescribed locations in the lower case 11*a*. The sensor portion 63*c* has a specific projection/recess pattern indicative of kind and width of the web roll. Therefore, different projection/recess patterns are provided for different kind and width of the web roll. The cassette detection switches 60 are depressed by the projection pattern for recognizing the kind and width of the web roll.

L shaped regulation segments 74 and 75 protrude from one external side of the left and right holders 62 and 63, respectively, and are bent toward a longitudinal center of the web roll 20 to provide web regulating portions extending in an axial direction of the web roll. The web regulating portions have sufficiently short lengths so as to avoid mechanical interference between the tip ends of the web regulating portions when the engaging pawls 64 on the inner boss 62*a* of the holder 62 is directly engaged with the engaging holes 68 of the inner boss 63*a* of the holder 63 in case a web roll of a minimum width is used.

When the holders 62, 63 holding the web roll 20 therebetween are mounted on the support portions 25, 26, respectively, the regulation plates 74, 75 are positioned at downstream side of the web roll 20 and at a lower portion of the holders 62, 63 as shown in FIG. 5. Further, the web roll 20 is held by the holders 62, 63 in such a manner that the leading end of the web is drawn out from the lower portion of the web roll 20. With this arrangement, the web drawn from the lower portion of the web roll 20 always passes below the lower edge of the regulation plates 74, 75 toward the platen 21.

This construction prevents the web sheet D2 from becoming loose on the web roll 20 and regulates feeding of the web sheet D2 to pass at a lower portions of the holders 62, 63. More specifically, in accordance with the printing operation, the diameter of the web roll 20 is gradually decreased. However, because of the provision of the regulation plates 74, 75, the passage of the web sheet is constantly maintained irrespective of the change in diameter of the web roll 20. In other words, a constant passage can be provided between the regulation segments 74,75 and the front discharge side of the cassette 11 regardless of the change in diameter of the web roll 20. Further, because of the provision of the regulation segments 74, 75, the web sheet D2 unwound from the web roll 20 can be easily mounted such that the left and right edges of the web sheet D2 are positioned along the side guide plates 29 and 30 (FIG. 8). This improves feeding performance.

Furthermore, these regulation segments 74 and 75 interfere with the web sheet D2 if the web sheet D2 is pulled in an irregular path. More specifically, when, as indicated by the path K1 of FIG. 5, the web sheet D2 is set so as to be drawn out from the upper periphery of the web roll 20, the web sheet D2 is first greatly bent at the lower edge of the regulating segments 74, 75 and then, when the upper case 11*b* is closed shut, is again greatly bent at the position of a guide rotation shaft 76 (described later). Therefore, even if the front edge of the web sheet D2 is drawn out to the position of a shutter 82 (FIG. 6, described later), when the upper case 11*b* is shut closed, the above-described bending action will greatly pull in the front edge of the web sheet backward. Because the limit switch 78 will no longer detect the leading end of the web sheet D2, a setting error can be detected.

In the case of the erroneous feed paths K2 and K3 shown in FIG. 5, first the web sheet D2 is greatly bent by the upper edge of the regulation segments 74, 75 and then, when the upper case 11*b* is closed shut, is greatly bent at the position of the guide rotation shaft 76. As a result, a setting error can be detected in the same manner as in the case of the feed path K1 described above. When setting is erroneous in this manner, feed resistance against drawing the web sheet D2 by the pinch roller 23 and the drive roller 22 will greatly increase to the point where smooth transport of the web sheet D2 becomes impossible. At this point, a transport error will occur so that, even if the error is not detected by the limit switch 78, the user can be advised of the setting error.

Furthermore, by the L-shaped arrangement of the regulation segments 74, 75, the holders 62 and 63 can be used for various kinds of web roll 20 having different width. That is, the pair of regulation segments 74 and 75 are not interfered with each other even if the web roll having an extremely short width is used because of sufficiently small axial length of the regulation segments 74, 75 as described above.

As shown in FIGS. 5 and 8, the guide rotation shaft 76 is provided on the lower surface of the upper case 11*b* and slidingly contacts the web sheet D2 as the web sheet D2 passes over the surface of the platen 21 at the opening 34 and is expelled from the front end discharge portion of the web roll cassette 11 along the feed passage 59. The guide rotation shaft 76 is configured to pull the leading edge of the web sheet D2 back from the discharge end of the web roll cassette 11 when the upper case 11*b* is closed if the web sheet is improperly set around the regulation segments 74 75 as like K2 and K3 in FIG. 5 as described above.

Figure 12:
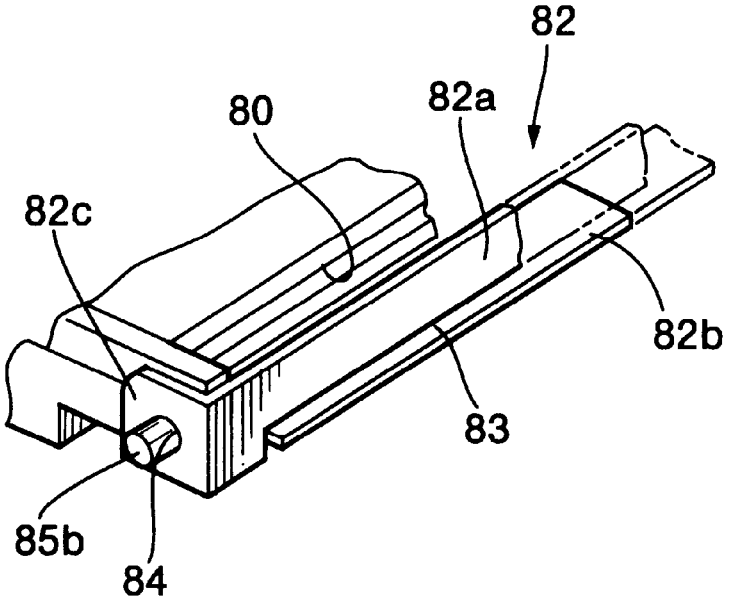
FIG. 12(*a*) is a partial perspective view showing a shutter in a closed state according to the embodiment.
Figure 12:
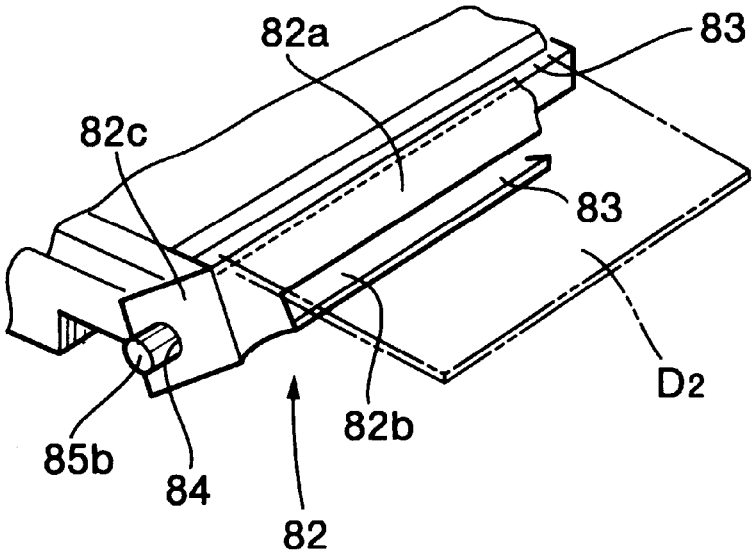
Figure 13:
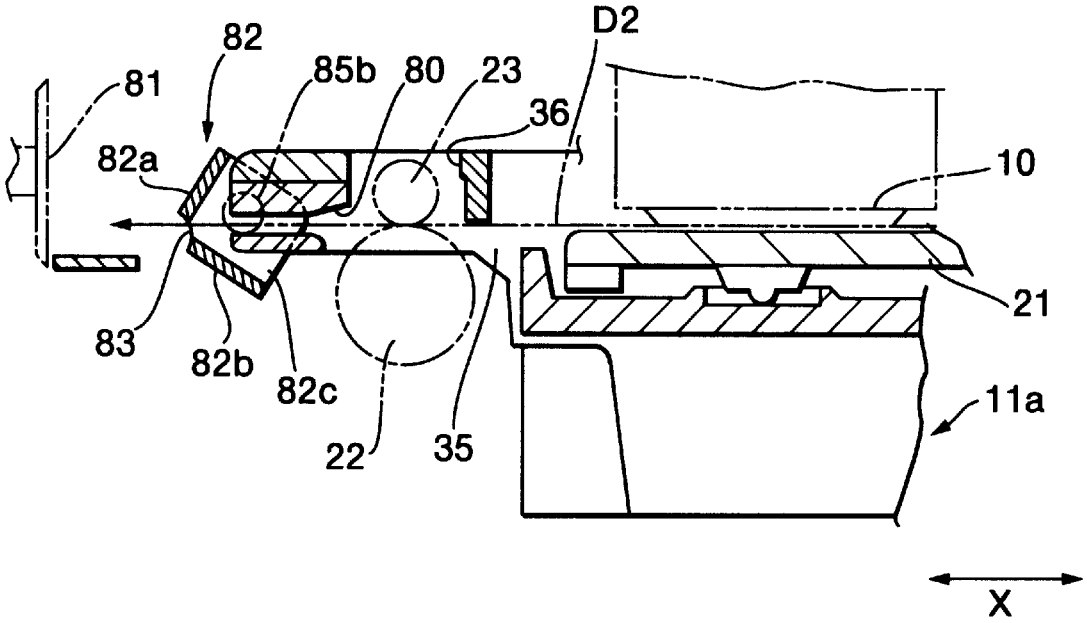
FIG. 13(*a*) is an enlarged side cross-sectional view showing the relative parts of the shutter in an open state.
Figure 13:
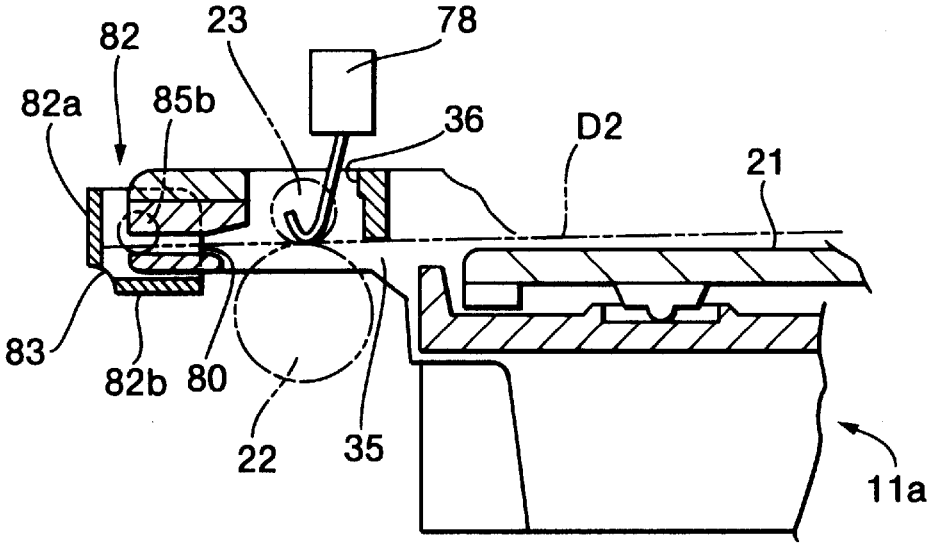

Next, the configuration for pulling the web sheet D2 from the web roll 20 will be described with reference to FIGS. 6, 8, 12(*a*), 12(*b*), 13(*a*) and 13(*b*). The shutter 82 is provided for opening and closing the passage 80 (FIG. 5) at the front end discharge portion of the web roll cassette 11. The shutter 82 has an L-shaped cross-section and has a vertical piece 82*a*, a bottom piece 82*b*, and left and right side pieces 82*c*. An insertion slot 83 is formed horizontally between a lower edge of the vertical piece 82*a* and a front edge of the bottom piece 82*b*. Left and right side pieces 82*c* are formed integrally with the left and right sides of the vertical piece 82*a* and bottom piece 82*b*. Shaft holes 84 are perforated through the left and right side pieces 82*c*. The shaft holes 84 are rotatably supported on left and right support shafts 85*a* and 85*b* extending from the lower case 11*a*. A torsion spring 86 (FIG. 6) is wrapped about the support shaft 85*a* and constantly applies a downward urging force on the shutter 82 to urge the insertion slot 83 out of alignment with the passage 80 so that the shutter 82 blocks the front of the passage 80, as shown in FIGS. 12(*a*) and 13(*b*). As shown in FIG. 13(*b*) the limit switch 78 extends into the through hole 36 for detecting the leading edge of the web sheet D2.

As shown in FIG. 8, a pressure member 87 extending in the widthwise direction of the web roll 20 protrudes downward from the inner surface of the frame body 2. Further, an abutment piece (not shown) is provided approximately horizontally on the vertical piece 82*a*. When the front end discharge portion of the web roll cassette 11 is pivotally moved upward using the pivot mechanism 24*b* so that the discharge portion is in line with the feed passage 59, the pressure member 87 pushes against the top side of the abutment piece. At this time, the shutter 82 is rotated such that the insertion slot 83 between the vertical piece 82*a* and the bottom piece 82*b* is in line with the passage 80 and the feed passage 59, as shown in FIGS. 12(*b*) and 13(*a*).

Next, operations for mounting and determining the position of the web roll 20 in the web roll cassette 11, and operations for mounting and detaching the web roll cassette 11 in relation to the printer 1 will be described.

First, while the web roll cassette 11 is removed from the frame body 2, the upper case 11*b* is pivotally moved in relation to the lower case 11*a* in a clockwise direction in FIG. 6, pivoting around the pivot shaft 28 near the accommodation space 27 as shown by the two dotted chain lines in FIG. 6. Next, the web roll 20 mounted on the holders 62 and 63 is placed in the support portions 25 and 26 of the lower case 11*a*. At this time, the web roll 20 is set such that the web sheet D2 is pulled from the lower surface of the web roll 20, as shown in FIG. 5. Hence, when pulled, the web sheet D2 passes across the lower surface of the regulation segments 74 and 75.

By opening the upper case 11*b* relative to the lower case 11*a*, a wide opening is created at the front end discharge portion between the lower case 11*a* and upper case 11*b*. Accordingly, setting work for setting the leading end portion of the web sheet D2 to a predetermined position can be easily performed. That is, the leading edge of the web sheet D2 can be easily pulled until the leading edge contacts the vertical piece 82*a* of the shutter 82. The positioning of the leading edge of the web sheet D2 can be performed easily by simply abutting the leading edge with the vertical piece 82*a* of the shutter.

When the upper case 11*b* is closed onto the lower case 11*a* while the leading end portion of the web sheet D2 is positioned at the front discharge side of the cassette 11, the leading end portion of the web sheet D2 can be maintained in a stretched condition without curling. Further, since the platen 21 is provided at the cassette 11 at a position upstream of the front discharge side of the cassette, the web sheet D2 is automatically interposed between the platen 21 and the thermal head 10 when the cassette 11 is installed in the printer 1. Accordingly, printing operation can be performed without fail. Furthermore, operation for feeding the web sheet D2 can be performed in a stabilized fashion because the through-holes 35, 36 are formed at a position between the front discharge side and the platen 21, and because the feeding mechanism such as the drive roller 22 and the pinch roller 23 are positioned in the through-holes 35, 36. Consequently, setting the web sheet D2 in the printer can be easily carried out.

With this state wherein the leading edge contacts the vertical piece 82*a* of the shutter 82, if the upper case 11*b* is closed in relation to the lower case 11*a*, the guide rotation shaft 76 on the lower surface of the upper case 11*b* presses slightly down widthwise across the surface of the web sheet D2. As a result, the leading edge of the web sheet D2 becomes separated from the vertical piece 82*a* of the shutter 82. Still however, the leading edge will not recede further upstream in the passage 80 than the through-hole 35. Also, as will be described later, at this time the leading edge will not recede so far that the pinch roller 23 and drive roller 22 set in the mounting portion can not convey the web sheet D2. That is, the retracting length of the web roll 20 still provide nipping of the web sheet D2 by the pinch roller 23 and the drive roller 22 when the web roll cassette 11 is moved to its horizontal posture.

Hence, the web sheet D2 is pulled as far as the front end discharge portion of the web roll cassette 11. With maintaining the closing state of the upper case 11*b*, as shown in FIGS. 2 and 3, the front end discharge portion is inserted through the insertion port 12 and between the guide frames 44 and 44. At this time, as shown by the solid line in FIG. 4, the front end discharge portion is sloped slightly downward, and the rear guide projections 46 and front guide projections 45 protruding from the inner surfaces of the guide frames 44 are inserted in order into the front open ends of the guide grooves 39. When the stop portions 41 at the rear of the guide grooves 39 abuts the rear guide projections 46, the top surfaces of the rear guide projections 46 are resiliently engaged by the locking springs 42. When the rear guide projections 46 are engaged with the stop portions 41, the front guide projections 45 are positioned in opposition to the notched portions 40, and the front end discharge portion is positioned opposing the top position of the drive roller 22.

Then, when the lever 56 is pivotally moved in the counterclockwise direction in FIG. 4, the support arm 52 rotates in the clockwise direction via the pressure roller 53 mounted on the operation arm 54. This rotation causes the first engaging portion 52*a* on the support arm 52 to press up against the front end discharge portion of the web roll cassette 11. At this time, the front end discharge portion is pivotally moved in counterclockwise direction around the cylindrical rear guide projections 46. The front notched portions 40 formed in the lower central sides of the guide grooves 39 are fit around the guide projections 45. Therefore, the web roll cassette 11 is locked in the frontward/rearward direction. The lever 56 is fixed in the raised position by the locking device (not shown).

When the front end discharge portion is set in line with the feed passage 59, the shutter 82 on the pressure member 87 is rotated so that the insertion slot 83 is in line with the feed passage 59, as shown in FIGS. 12(*b*) and 13(*a*). While the web roll cassette 11 is mounted in the frame body 2, the cassette detection switches 60 (FIG. 4) oppose the roll width detection sensor portions 63*c*.

When the front end discharge portion of the web roll cassette 11 is raised until the web roll cassette 11 is prevented from moving forward and backward, the sensor portion 63*c* press against and activate the cassette detection switches 60. When activated, these cassette detection switches 60 determine the position of the web roll cassette 11 and detect the width and type of the web roll 20.

The limit switch 78 shown in FIGS. 4 and 13(*b*) detects the leading edge of the web sheet D2. In this state, as indicated by the broken lines in FIG. 4, the platen 21, on which the web sheet D2 is positioned, opposes and is near to the thermal head 10 in the printing unit. Further, the leading edge of the web sheet D2 is positioned at the front end discharge portion and is nipped between the pinch roller 23 and the drive roller 22. Hence, the web sheet D2 can be conveyed.

During a printing operation, the thermal head 10 moves back and forth in the Y-direction orthogonal to the movement of the web sheet D2, which is conveyed in the X-direction (see FIG. 2). When printing operations are completed, the drive roller 22 is positively rotated so that the web sheet D2 is transported exactly by a predetermined distance in the direction X. Consecutively with this, the rotary type cutter 81 cuts the web sheet D2 in the Y direction. Afterward, the drive roller 22 is driven slightly in the reverse direction so that a cut edge or a leading edge portion of the web sheet D2 which has not yet been printed on, is retracted into the passage 80 of the front end discharge portion. Here, the web sheet D2 is retracted (rewound) by a controlled distance so that the new leading edge portion of the web sheet D2 will be downstream in the transport direction from the nip portion formed between the drive roller 22 and the pinch roller 23. Therefore, the leading end portion is still nipped by these rollers 22 and 23.

By retracting the web sheet D2 in this manner, when the web roll cassette 11 is removed or mounted (at time of cassette exchange), the leading edge portion of the web sheet D2 will not protrude from the front end discharge portion of the web roll cassette 11. Therefore, there is no danger to the leading end portion of the web sheet 2 catching on components of the frame body 2 of the recording device 1. Therefore, the web roll cassette 11 can be smoothly removed and inserted. Further, when the web roll cassette 11 is mounted, the web sheet D2 can be securely sandwiched between the drive roller 22 and the pinch roller 23 so that paper jams can be properly prevented.

During printing operation if a sheet jamming occurs, the user pivotally moves the lever 56 in the clockwise direction in FIG. 4. By the clockwise movement of the lever 56, the pressure roller 53 in contact with the support arm 52 is moved toward the pivot shaft 51, so that the support arm 52 is pivotally moved in the counterclockwise direction about the pivot shaft 51 by the weight of the cassette 11 and the weight of the drive roller 22 supported to the support arm 52. Accordingly, the front end discharge portion of the web roll cassette 11 is no longer supported by the first engaging portion 52*a*, and therefore, the front end discharge portion of the web roll cassette 11 is pivotally moved downwardly about the rear guide projection 46. This action separates the pinch roller 23 from the drive roller 22, releasing the web sheet D2. At this time, the front guide projections 45 are now out of the notched portions 40 and back in the middle of the guide grooves 39. Therefore, the jammed web sheet D2 can be easily released after removing the web roll cassette 11 from the insertion port 12. That is, relatively wide open space can be provided around the sheet feed passage in the printer after removal of the cassette 11 from the printer 1.

In this way, the web roll cassette 11 can only be mounted in or detached from the frame body 2 when the front end discharge portion is sloped downward. This is advantageous in protecting the printing unit. That is, if sheet jamming occurs at the printing unit, and if the web roll cassette 11 can be removed without changing its inclination, the rearward movement of the web roll cassette 11 may damage to the printing unit due to the jamming sheet. In the illustrated embodiment, because the web roll cassette 11 cannot be removed while maintaining its horizontal posture because of the mechanical abutment between the recess 40 and the front guide projection 45, but the cassette 11 can only be removed when the web roll cassette 11 is sloped down, a wide open space can be provided at the printing unit, so that the printing unit can be protected against the jamming sheet.

Further, by including the drive roller 22 in the pivot mechanism 24*b*, both the operation of pinching the web sheet D2 for conveying purposes or releasing the web sheet D2, and the operation for changing the position of the web roll cassette 11 are performed simultaneously, thereby simplifying the construction of the device.

By providing the platen 21 on the web roll cassette 11 side, the platen 21 is positioned near the printing unit when the web sheet D2 is conveyed and is separated from the printing unit when the web roll cassette 11 is detached. Therefore, the process of resolving a paper jam in the printing unit can be facilitated, and there is no need to provide a separate mechanism for moving the platen toward and away from the printing unit, thereby simplifying the construction of the recording device.

Next, a construction for selectively supplying a cut sheet 98 (see FIG. 16), such as a postcard, using only one web roll cassette 11 will be described with reference to FIGS. 8 and 14.

Figure 14:
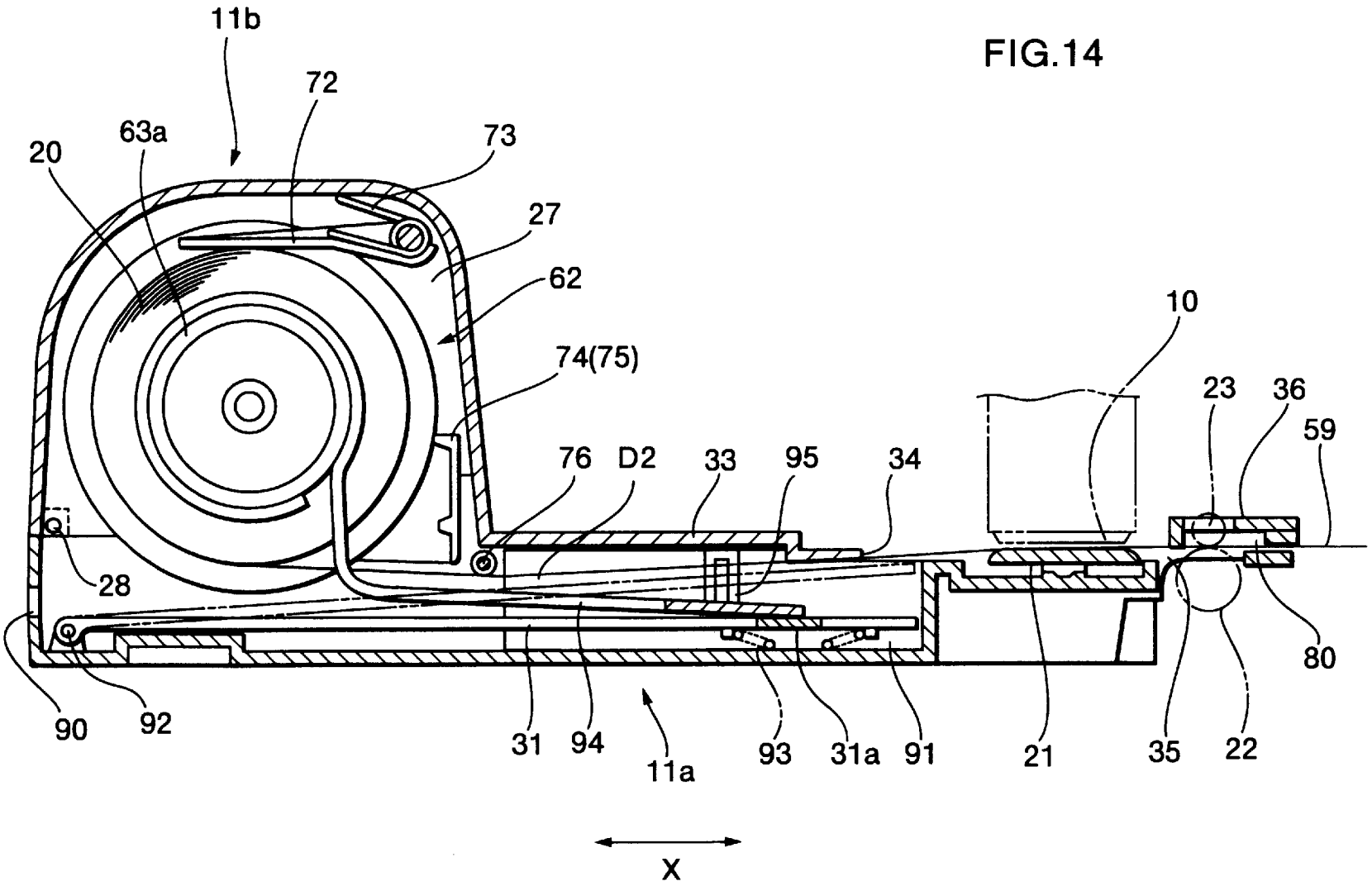
FIG. 14 is a cross-sectional view taken along the line XIV—XIV in FIG. 8.
Figure 16:
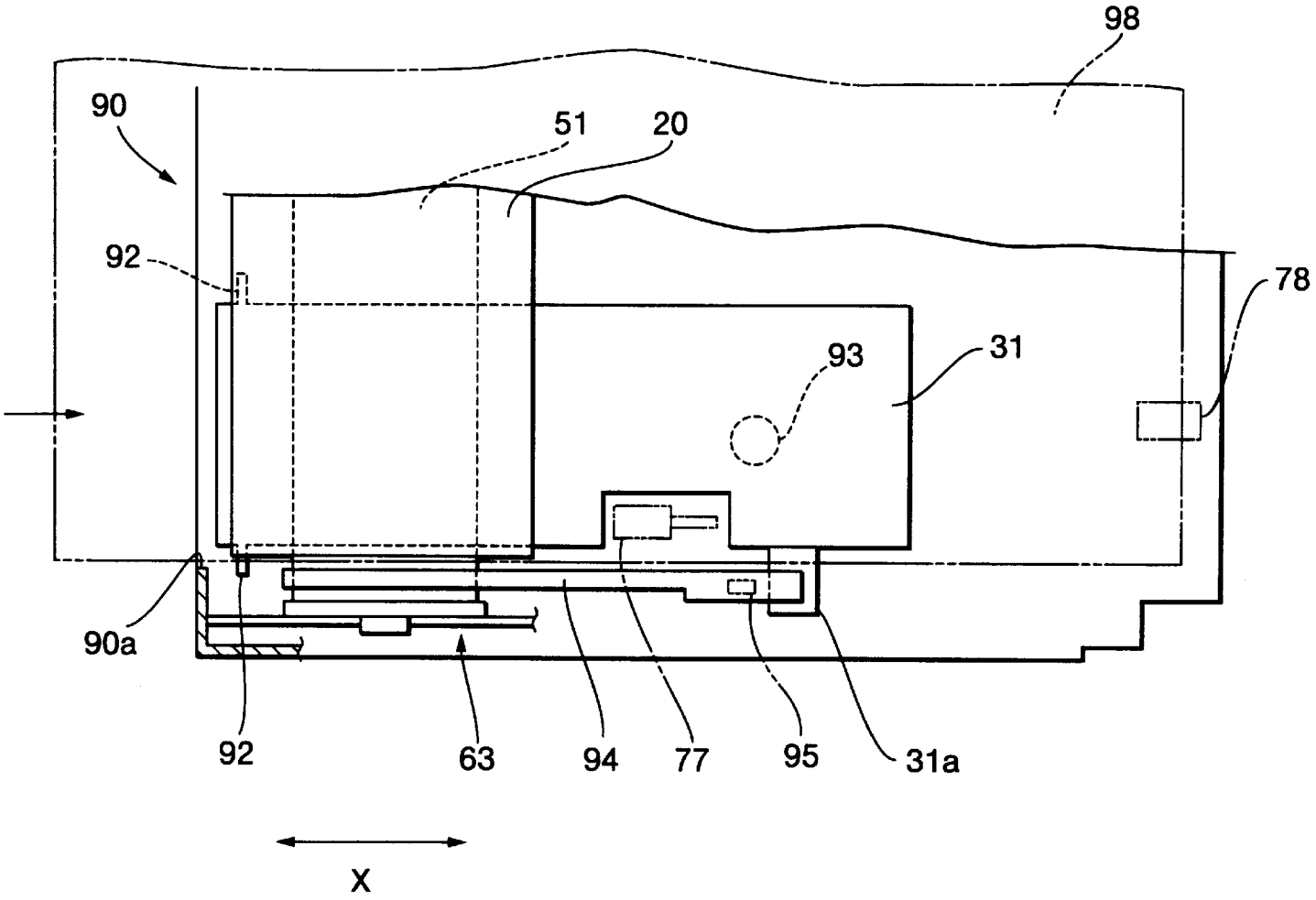
FIG. 16 is a partial plan view showing the relevant parts in the lower case of the web roll cassette according to the embodiment.

As shown in FIGS. 14 and 16, a supply port 90 is penetratingly provided on the rear surface of the lower case 11*a* to allow the insertion of cut sheets 98 in the lower portion of the accommodation space 27. A feed space 91 is provided between the lower case 11*a* and upper case 11*b* from the lower portion of the accommodation space 27 to the opening 34 in which the platen 21 is exposed. In this feed space 91, a pivot shaft 92 is disposed on the lower case 11 at a position adjacent to and lower then the supply port 90.

The tray 31 is pivotably provided on the pivot shaft 92. The tray 31 is positioned at one lateral side of the web sheet passage. That is, as shown in FIG. 16, the tray 31 is positioned close to the holder 63, and is positioned remote from the holder 62. The other end of the tray 31 is free and is urged upward by a biasing spring 93. A support portion 31*a* protrudes from one side of the tray 31 in the Y direction and at the free end of the tray 31. A relay lever 94 is rotatably fitted around the inner boss 63*a* of the holder 63. The free end of the relay lever 94 rests on the top surface of the support portion 31*a*. A pressure portion 95 protrudes downward from the bottom surface of the upper case 11*b* for pressing downward only on the relay lever 94 at a location other than the portion of the relay lever 94 that intersects the support portion 31*a* (for example, the lengthwise middle of the relay lever 94), as shown in FIGS. 8 and 14. Therefore, when the web roll 20, including the holders 62 and 63, is mounted in the support portions 25 and 26, the free end of the relay lever 94 rests on the support portion 31*a*. When the upper case 11*b* is closed, the pressure portion 95 presses downward on the center portion of the relay lever 94. This downward force is transferred to the support portion 31*a*, causing the free end of the tray 31 to move downward against the urging force of the biasing spring 93. After moving downward, the tray 31 is no longer restraining the web sheet D2, which has been pulled through the feed space 91 to the opening 34. Accordingly, the web sheet D2 can now be pulled smoothly from the web roll 20 without resistance.

Figure 15:
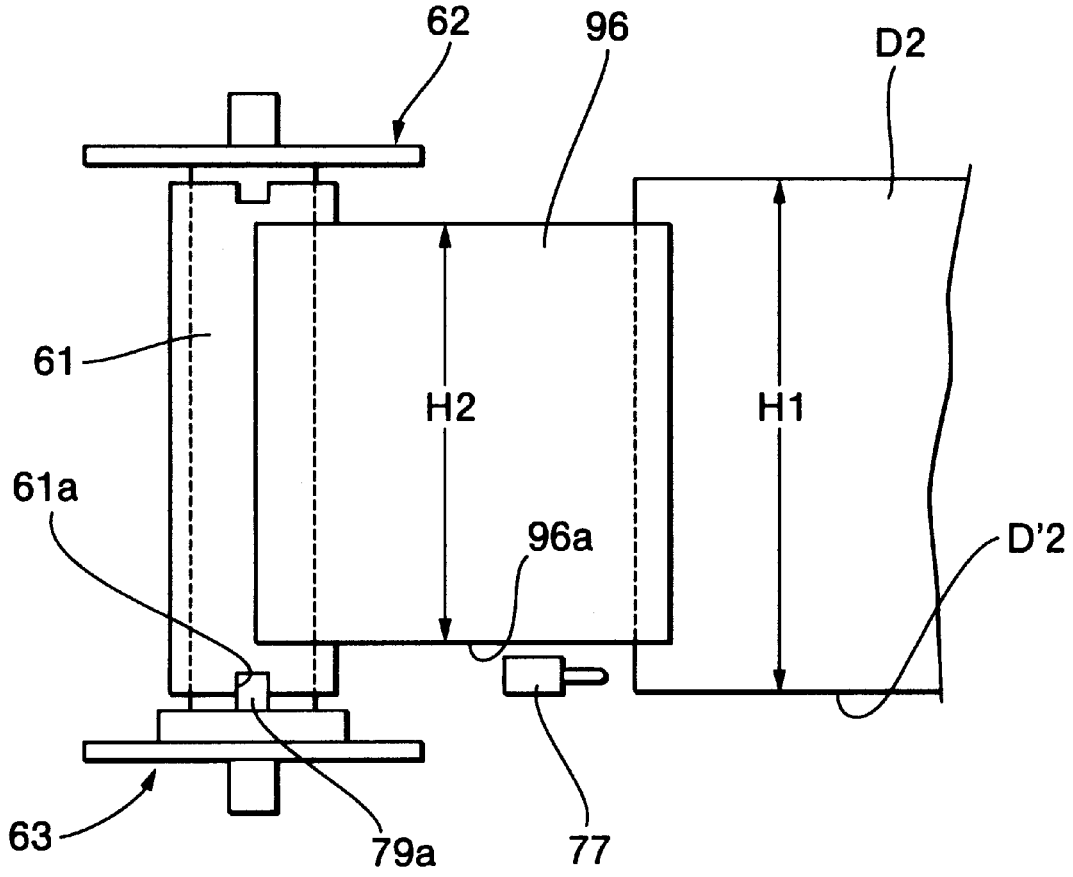
FIG. 15 is an explanatory diagram showing a mounting portion at an end of a recording medium or a web sheet D2 in relation to the sheet tube.

As shown in FIG. 15, the trailing edge of the web sheet D2, which has a width H1, is adhered to a link piece 96 having a narrower width H2 via an adhesive agent or an adhesive tape. The other end of the link piece 96 is joined to the sheet tube 61 via an adhesive agent or an adhesive tape. Here, the link piece 96 is joined so that at least one side edge 96*a* of the link piece 96 is nearer the widthwise center than a corresponding side edge D2' of the web sheet D2. Further, a trailing edge detection sensor 77 such as a limit switch is positioned at an outer side of the link piece 96 but inside the web sheet D2. The trailing edge detection sensor 77 is also adapted to detect a trailing edge of a cut sheet 98 as described later.

Hence, when the web sheet D2 is unwound from the sheet tube 61, the trailing edge detection sensor 77 does not detect the link piece 96, but detects only the trailing edge of the web sheet D2. This trailing edge detection sensor 77 can be disposed either on the web roll cassette 11 or on the printer 1. As shown in FIG. 16, a side edge 90*a* of the supply port 90 is positioned near the side edge of the tray 31, so that one side of the cut sheet 98 is guided along this side edge 90*a* when feeding the cut sheet 98.

With this construction, the upper case 11*b* is opened and the web roll 20 and holders 62 and 63 are removed from the accommodation space 27 in order to print on a cut sheet 98. Removal of these components releases the relay lever 94. Therefore, the pressure portion 95 will not press down on the tray 31 even after closing the upper case 11*b*, and the tray 31 will be urged upward by the biasing spring 93. At this time, if a cut sheet 98 is inserted through the supply port 90, the leading edge of the cut sheet 98 is guided over the tray 31 and the platen 21 and is introduced into the passage 80. Hence, while the cut sheet 98 is conveyed in the X-direction by the drive roller 22 and pinch roller 23 and printed by the thermal head 10, the trailing edge of the cut sheet 98 can be detected by the trailing edge detection sensor 77. Accordingly, it is easy to set the timing in which the printing is completed, as well as the timing in which the operation of the drive motor for conveying is completed in the printing operation for the cut sheet.

On the other hand, when printing on the web sheet D2 unwound from the web roll 20, the trailing edge of the web sheet D2 can be detected when the narrower link piece 96 unwinds and exposes the trailing edge detection sensor 77. Here, too, it is easy to set the timing in which the printing is completed, as well as the timing in which the operation of the drive motor for conveying is completed in the printing operation for the web roll 20.

In this way, the single trailing edge detection sensor 77 can detect the trailing edge of the web sheet D2 and the trailing edge of the cut sheet 98. Accordingly, it is not necessary to preprint a mark along the side of the trailing end. Further, an inexpensive sensor can be employed, rather than the high cost photosensors used conventionally. Furthermore, it is not necessary to provide a separate tray for the cut sheets. If the web roll is accommodated in the web roll cassette 11, the pressure portion 95 presses the support portion 31*a* of the tray 31 downwardly through the relay lever 94. If the web roll is not accommodated in the web roll cassette 11, the support portion 31*a* is not pressed downwardly because the relay lever 94 is not provided in the web roll cassette 11. Thus, the posture of the tray 31 can be selectively changed only by the accommodation or removal of the web roll into or from the web roll cassette 11. Consequently, erroneous operation depending on the change in the recording medium between the cut sheet and the web roll is avoidable.

While the invention has been described in detail and with reference to the specific embodiments thereof, it would be apparent to those skilled in the art that various changes and modifications may be made therein without departing from the spirit and scope of the invention.

For example, the link piece 96 can be omitted and the trailing end of the web sheet D2 can be cut to a narrower width and adhered directly to the sheet tube 61 via an adhesive agent or an adhesive tape.

Further, in another variation of the embodiment described above, instead of the above described pressure portion 95 (FIG. 16), a selection lever (not shown) can be rotatably mounted on the side surface of the lower case 11*a* or on the side or top surface of the upper case 11*b*. According to the angular position of the selection lever, the selection lever would either press down on the support portion 31*a* of the tray 31 against the urging force of the biasing spring 93 and maintain the tray 31 in a downward position, or release the tray 31 and allow the free end of the 31 to pivot upward.

Further, the printing unit of the present invention is not limited to a thermal head type printing unit, but can also be an ink-jet type printing unit.

Further, if the web sheet D2 is a heat-sensitive paper, the ribbon cassette 14 is unnecessary and the thermal head 10 can print directly on the web sheet without the ink ribbon.

Further, in the depicted embodiment, for preventing the holders 62 and 63 from rotating in the support portions 25, 26, the sensor portion 63*c* of the holder 63 fits in the opening formed in the lower case 11*a*. As an alternative example, the support bosses 62*b* and 63*b* can be formed with non-circular outer diameters and non-rotatably supported in the support portions 25 and 26, respectively.

Further, in the depicted embodiment, the drive roller 22 and the associated pivot mechanism 24*b* are positioned below the sheet feed passage 59, and the pinch roller 23 is positioned above the sheet feed passage 59. However, the relative positions can be reversed such that the drive roller 22 and the pivot mechanism 24*b* are positioned above the sheet feed passage 59 and the pinch roller 23 is positioned therebelow. In the latter case, a notched portion 40 can be formed in the upper area of the guide groove 39 so that operation for installing and detaching the web roll cassette 11 are possible only when the front end discharge portion of the web roll cassette 11 is in an upward slanting posture.

Further, in the depicted embodiment, the front and rear guide projections 45 and 46 are provided at the guide frame 44 of the frame body 2, and the corresponding guide grooves 39 are formed at the sides of the web roll cassette 11. However, the guide projections 45 and 46 can be provided at the side of the web roll cassette, and the guide grooves opening to the insertion port 12 can be formed in the guide frame 44. In the latter case, a notched portion can be formed at an upper area of a deep end of the guide groove, so that the notched portion is in alignment with the front guide projection 45 when the front end discharge opening of the web roll cassette is pivotally moved upwardly. Still however, the side of the web roll cassette is preferably formed with the guide groove rather than the front and rear guide projections, since a damage to the guide groove may be less probable than a damage to the guide projections when the web roll cassette 11 is not mounted in the recording device 1.

What is claimed is:

1. An image recording device for forming an image on a web sheet comprising:

a frame body provided with a web roll cassette insertion port, a web roll cassette accommodating portion, and a web sheet passage extending from the web roll cassette accommodating portion in a sheet feeding direction;

a web roll cassette detachably mounted in the web roll cassette accommodating portion through the cassette insertion port, the web roll cassette comprising a case accommodating therein a web roll from which the web sheet is unwound in the sheet feeding direction, the web roll cassette having a front end discharge portion directing toward the web sheet passage, the casing being formed with a through hole at a position adjacent the front end discharge portion;

a cutter unit positioned downstream of the front end discharge portion in the sheet feeding direction for cutting the web sheet drawn out of the front end discharge portion;

a sheet feeding unit for feeding the web sheet in the sheet feeding direction, the sheet feeding unit comprising a pair of nipping members positioned at the through hole for nipping the web sheet between the pair of nipping members; and, a printing unit for printing the image on the web sheet fed by the sheet feed unit.

2. The image recording device as claimed in claim 1, wherein the pair of nipping members comprise a drive roller positioned at the through hole in contactable with one surface of the web sheet, and a pinch roller positioned at the through hole in contactable with an opposite surface of the web sheet, at least one of the drive roller and the pinch roller being movable toward and away from the web sheet.

3. The image recording device as claimed in claim 2, wherein the feeding unit comprises a controller for controlling the rotation of the drive roller so that a cut leading end of the web sheet is fed in a direction opposite the sheet feeding direction into the front end discharge portion after the cutter unit cut the web sheet, but the cut leading end is stopped at a position downstream of the through hole, whereby the cut leading end is still nipped by the drive roller and the pinch roller after the reversal feeding.

4. The image recording device as claimed in claim 2, wherein the case of the web roll cassette comprises:

a lower case having one side and another side;

an upper case supported on the lower case and having one side and another side, the upper and lower cases selectively providing an opening state and a closing state and defining therein an accommodation space at the one side for accommodating therein the web roll in the closing state, the front end discharge portion being formed at the another side of the upper and lower cases in the closing state.

5. The image recording device as claimed in claim 4, wherein the upper and lower cases are formed with the through holes, respectively, the drive roller being positioned in one of the through holes, and the pinch roller being positioned in a remaining through hole.

6. The image recording device as claimed in claim 4, wherein the upper case is pivotally movably connected to the lower case at the one side.

7. The image recording device as claimed in claim 4, wherein the web roll cassette further comprises:

a pair of side guide plates provided between the front end discharge portion and the accommodation space for guiding lateral side edges of the web sheet unwound from the web roll;

a pair of holders positioned at lateral side edges of the web roll for rotatably supporting the web roll;

a pair of support portions provided in the accommodation space for detachably and non-rotatably supporting the pair of holders; and at least one regulation segment provided at least one of the holders for regulating a drawn out position of the web sheet from the web roll and for directing the web sheet along the pair of side guide plates.

8. The image recording device as claimed in claim 7, wherein the pair of side guide plates and the pair of support portions are provided on the lower case;

and wherein the regulation segment is located at a lower portion of the holder member and at a position downstream side of the holder member when the pair of holders are non rotatably supported by the pair of support portions;

and wherein the web roll being supported by the pair of support portions through the pair of holders so that the web sheet is drawn out from the web roll at a lower portion thereof.

9. The image recording device as claimed in claim 8, wherein the at least one regulation segment is sized so that the web sheet can be smoothly drawn out from the web roll if the web sheet is drawn out from the web roll at the lower portion thereof and if the web sheet passes below a lower edge of the at least one regulation segment, whereas smooth drawing of the web sheet from the web roll is restrained if the web sheet is drawn out from the web roll at an upper portion thereof or if the web sheet passes above an upper edge of the at least one regulation segment.

10. The image recording device as claimed in claim 9, wherein the upper case is pivotally movably connected to the lower case at the one side, and further comprising:

a guide rotation shaft provided to the upper case and positioned downstream of the at least one regulation segment in the closing state for guiding the web sheet toward the platen, the guide rotation shaft pulling the web sheet toward upstream when the upper case is closed onto the lower case if the web sheet is erroneously set relative to the regulation segment or if the web roll is erroneously set relative to the holders.

11. The image recording device as claimed in claim 1, wherein the web roll cassette further comprises a platen positioned upstream of the through hole and confrontable with the printing unit when the web roll cassette is installed in the web roll cassette accommodating portion.

12. The image recording device as claimed in claim 1, wherein the web roll cassette has a pair of side ends, and wherein the web roll cassette accommodating portion has a pair of side walls each in confrontation with each side end, and the image recording device further comprising:

a pair of front guide projection and a rear guide projection positioned upstream of the front guide projection in the sheet feeding direction, the front and rear guide projections protruding, in a direction perpendicular to the sheet feeding direction, from one of the pair of side ends of the web roll cassette and the pair of side walls;

a guided member having a groove slidingly engageble in the pair of front and rear guide projections when the web roll cassette is installed into the web roll accommodating portion through the insertion port, the guided member being provided at remaining one of the pair of side ends and the pair of side walls, the engagement between the front and rear guide projections and the groove defining an inserting position of the web roll cassette; and a pivot mechanism provided in the web roll accommodating portion for pivotally moving, about the rear guide projection, the web roll cassette so that the front end discharge portion of the web roll cassette is moved from the inserting position toward the web sheet passage and into an operating position.

13. The image recording device as claimed in claim 12, wherein the guided member is formed with a notched portion at a position in alignment with the front guide projection, the front guide projection being engaged with the notched portion when the web roll cassette is pivotally moved to the operating position, whereby the web roll cassette is locked at the operating position.

14. The image recording device as claimed in claim 13, wherein the front and rear guide projections are provided at the pair of side walls, and the guided member is provided at the pair of side ends.

15. The image recording device as claimed in claim 14, wherein the guided member has a rear end provided with a stop portion abuttable against the rear guide projection when the web roll cassette is inserted into the web roll cassette accommodating portion;

and wherein the web roll cassette further comprises a locking spring engageable with the rear guide projection when the stop portion engages the rear guide projection whereby the web roll cassette is pivotally movable about the rear guide projection.

16. The image recording device as claimed in claim 15, wherein the pair of nipping members comprise a drive roller positioned at the through hole in contactable with one surface of the web sheet, and a pinch roller positioned at the through hole in contactable with an opposite surface of the web sheet, at least one of the drive roller and the pinch roller being movable toward and away from the web sheet.

17. The image recording device as claimed in claim 16, wherein the drive roller is rotatably supported on the pivot mechanism, whereby the drive roller is moved toward the web sheet when the web roll cassette is pivotally moved from the inserting position to the operating position, and is moved away from the web sheet when the web roll cassette is pivotally moved from the operating position to the inserting position.

18. An image recording device for forming an image on a web sheet unwound from a web roll comprising:

a frame body formed with a cassette insertion port, a cassette accommodating portion, and a feed passage positioned downstream of the cassette accommodating portion;

a feeding unit for feeding the web sheet along the feed passage in a feeding direction;

a printing unit for printing an image on the web sheet;

a front guide projection protruding from the cassette accommodating portion;

a rear guide projection protruding from the cassette accommodating portion and at a position higher than the front guide projection;

a pivot mechanism for pivotally moving the web roll cassette between an operating position in horizontal alignment with the rear guide projection and a slanted inserting position;

and a web roll cassette housing therein the web roll serving as an image recording medium, the web roll cassette comprising:

a lower case having one side and another side;

an upper case supported on the lower case and having one side and another side, the upper and lower cases selectively providing an opening state and a closing state and defining therein an accommodation space at the one side for accommodating therein the web roll in the closing state, and a front end discharge portion being formed at the another side of the upper and lower cases in the closing state, the front end discharge portion being engageable with the pivot mechanism;

a platen provided at a position upstream of the front discharge portion in the feeding direction, the platen being confrontable with the printing unit, and through holes being formed in the upper and lower cases at a position between the front discharge portion and the platen for allowing the feeding unit to be positioned in the through holes, a guide groove being formed at a lateral side of the lower case for engaging with the front and rear guide projections.

19. The image recording device as claimed in claim 18, wherein the web roll cassette further comprises a stop portion engageable with the rear guide projection, a notched portion being formed at the guide groove for engagement with the front guide projection to maintain the operating position.

20. The image recording device as claimed in claim 19, further comprising a leaf spring disposed between the guide groove and the web roll cassette accommodating portion for preventing the web roll cassette from being laterally displaced in the web roll cassette accommodating portion.

21. An image recording device for forming an image on a web sheet comprising:

a frame body provided with a web roll cassette insertion port, a web roll cassette accommodating portion, and a web sheet passage extending from the web roll cassette accommodating portion in a sheet feeding direction, the web roll cassette accommodating portion having a pair of inner side walls;

a web roll cassette detachably mounted in the web roll cassette accommodating portion through the cassette insertion port, the web roll cassette comprising a case accommodating therein a web roll from which the web sheet is unwound in the sheet feeding direction, the web roll cassette having a front end discharge portion directing toward the web sheet passage, the web sheet unwound from the web roll being discharged out of the web roll cassette through the front end discharge portion, the case having a pair of side ends each in confrontation with each inner side wall of the web roll cassette accommodating portion;

a sheet feeding unit for feeding the web sheet in the sheet feeding direction;

a printing unit for printing the image on the web sheet fed by the sheet feed unit;

a pair of front guide projection and a rear guide projection positioned upstream of the front guide projection in the sheet feeding direction, the front and rear guide projections protruding, in a direction perpendicular to the sheet feeding direction, from one of the pair of side ends of the web roll cassette and the pair of inner side walls;

a guided member having a groove slidingly engageble in the pair of front and rear guide projections when the web roll cassette is installed into the web roll accommodating portion through the insertion port, the guided member being provided at remaining one of the pair of side ends and the pair of inner side walls, the engagement between the front and rear guide projections and the groove defining an inserting position of the web roll cassette; and a pivot mechanism provided in the web roll accommodating portion for pivotally moving, about the rear guide projection, the web roll cassette so that the front end discharge portion of the web roll cassette is moved from the inserting position toward the web sheet passage and into an operating position.

* * * * *